US010309110B2

(12) United States Patent
Mullaney et al.

(10) Patent No.: US 10,309,110 B2
(45) Date of Patent: Jun. 4, 2019

(54) CLIP

(71) Applicant: Lifting Point Pre-Form Pty Limited, Penrith, New South Wales (AU)

(72) Inventors: Nicholas Bruce Mullaney, Marulan (AU); James Richard Howell, Clarence Town (AU)

(73) Assignee: Lifting Point Pre-Form Pty Limited, Penrith, New South Wales (AU)

( * ) Notice: Subject to any disclaimer, the term of this patent is extended or adjusted under 35 U.S.C. 154(b) by 0 days.

(21) Appl. No.: 15/575,173

(22) PCT Filed: May 18, 2016

(86) PCT No.: PCT/AU2016/050374
§ 371 (c)(1),
(2) Date: Nov. 17, 2017

(87) PCT Pub. No.: WO2016/183627
PCT Pub. Date: Nov. 24, 2016

(65) Prior Publication Data

US 2018/0142475 A1 May 24, 2018

(30) Foreign Application Priority Data

May 19, 2015 (AU) ..... 2015901816

(51) Int. Cl.
*E04C 5/16* (2006.01)
*E04C 5/20* (2006.01)
(Continued)

(52) U.S. Cl.
CPC ..... *E04C 5/20* (2013.01); *B28B 23/024* (2013.01); *E04C 5/201* (2013.01); *E04G 21/12* (2013.01); *E04C 5/168* (2013.01)

(58) Field of Classification Search
CPC . E04C 5/20; E04C 5/201; E04C 5/168; B28B 23/024; E04G 21/12
See application file for complete search history.

(56) References Cited

U.S. PATENT DOCUMENTS 3,017,205 A 1/1962 Williams
3,255,565 A * 6/1966 Menzel ..... E04C 5/206 249/30

(Continued)

FOREIGN PATENT DOCUMENTS

| | | |
|---|---|---|
| DE | 8507748 | 9/1985 |
| DE | 4300490 | 7/1994 |
| FR | 2690703 | 5/1993 |

OTHER PUBLICATIONS

International Search Report for Application No. PCT/AU2016/050374 dated Jul. 1, 2016 (3 pages).

(Continued)

*Primary Examiner* — Paola Agudelo
(74) *Attorney, Agent, or Firm* — Michael Best & Friedrich LLP

(57) ABSTRACT

In summary, the invention provides a clip for use in the construction of a reinforced concrete panel, the panel being reinforced by a mesh comprising a plurality of parallel line wires and a plurality of parallel cross-wires connected to the line wires, the clip comprising: a base configured to engage a side wall that, in use, defines a formwork of the panel; and a body extending from the base, the body being configured to retain a line wire or a cross-wire of the mesh in an operative position of the mesh.

18 Claims, 18 Drawing Sheets

(51) Int. Cl.
*B28B 23/02* (2006.01)
*E04G 21/12* (2006.01)

(56) References Cited

U.S. PATENT DOCUMENTS 3,471,987 A * 10/1969 Yelsma ..... E04C 5/20 52/684
3,673,753 A 7/1972 Anderson
4,506,428 A * 3/1985 Gerhard ..... B28B 7/0029 264/228
4,800,702 A * 1/1989 Wheeler ..... E04C 5/168 249/217
4,856,244 A 8/1989 Clapp
5,005,331 A * 4/1991 Shaw ..... E01C 11/14 52/396.02
5,107,654 A * 4/1992 Leonardis ..... E04C 5/20 52/677
5,205,942 A * 4/1993 Fitzgerald ..... E01C 19/502 249/3
5,216,866 A 6/1993 Ekedal
5,893,252 A 4/1999 Hardy, Jr. et al.
6,658,810 B2 * 12/2003 DeLoach, Sr. ..... B28B 23/024 249/18
7,328,538 B2 * 2/2008 Trangsrud ..... E04C 5/20 52/682
2003/0183742 A1 10/2003 Deloach
2003/0192272 A1 10/2003 Bravinski
2011/0047915 A1 * 3/2011 Waters, Jr. ..... E04C 2/06 52/414
2014/0306088 A1 10/2014 Dryburgh et al.

OTHER PUBLICATIONS

International Preliminary Report on Patentability for Application No. PCT/AU2016/050374 dated Jul. 26, 2017 (109 pages).
European Patent Office Search Report for Application No. 16795551.7 dated Apr. 11, 2018, 9 pages.

* cited by examiner 1
10
12
14
16
35
35a
35b
37
80
81
81b
82
83
84

CLIP

TECHNICAL FIELD

This invention relates to a method of constructing a preform panel for receiving a settable material and more particularly to a clip for constructing the preform panel.

BACKGROUND

Concrete panels or slabs are used in a myriad of applications commercially, industrially and residentially: from the construction of a deck or a patio to the foundation of buildings and other forms of industrial infrastructure.

There are two main methods to assemble a reinforced concrete panel. First, for smaller or bespoke jobs, the panel is fully constructed in situ. Here the placement of side-forms and reinforcement mesh is laid out on site, and concrete is poured to cure or set in place. While this method produces custom-made panels, there are no standard panel kits currently available, thus the individual construction of panels is time-consuming, requires skill and expertise to do properly, and can entail high costs including but not limited to on-site labour, supervision and quality control.

The second, alternative method is a 'precast' method. This involves the full assembly of the formwork, and the pouring, setting and curing of the concrete in a remote location e.g. factory or builders yard. The completed panels are then transported to the site for use ready to be oriented and installed in the predetermined configuration. This method gives high quality control over the panel in the factory, and overall labour expenses are reduced. However, transport of the precast concrete panels is expensive and cumbersome due to their weight and bulk. There is additional cost and manpower required to further move the panels around a site and there is the inherent risk of damage to the panels during both transportation and installation on the site.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, a limited number of the exemplary methods and materials are described herein.

SUMMARY OF THE INVENTION

In accordance with the present invention, there is provided a clip for use in the construction of a reinforced concrete panel, the panel being reinforced by a mesh comprising a plurality of parallel line wires and a plurality of parallel cross-wires connected to the line wires, the clip comprising: a base configured to engage a side wall that, in use, defines a formwork of the panel; and a body extending from the base, the body being configured to retain a line wire or a cross-wire of the mesh in an operative position of the mesh.

The wire may be retained via a twist-lock action.

The wire may be retained in any one of a number of predetermined positions.

An advantage of the invention is to provide an overall construction system for forming reinforced concrete panels that ameliorates some of the disadvantages and limitations of the known art or at least provide the public with a useful choice.

The clip forms a connection between the reinforcement mesh and the side walls of the formwork. As such, it provides a structural element to the overall preform panel assembly, giving the preform a stable, rigid structure well suited to receiving and retaining a concrete mix.

The clip is configured to resist structural forces that occur during transport and/or assembly and/or installation of the panels e.g. the twisting of the formwork, the mass of the settable material, and the longitudinal, horizontal, twisting and sheer forces. The clip is configured to resist forces in a number of different directions simultaneously. In some embodiments angled corner members can be employed to retain the side walls in parallel and resists skewing of the panels.

The clip may be configured to attach to two layers of reinforcement mesh simultaneously thereby resisting slipping of the layers relative to one another and relative to the side walls, keeping the preform panel more rigidly constrained.

The clip may be formed from a resilient material. This allows the flexible clip to be used for curves or irregular shaped panels.

This resilience of the clip allows for expansion and contraction of the concrete panel, once the concrete has cured.

In use, the clips locate and retain the reinforcement at a predetermined level within the finished panel. This is important as concrete is not impervious to water and a peripheral portion of any concrete panel will soak up moisture. When a reinforcement mesh is too close to the surface of a concrete panel, the moisture within the concrete can attack and corrode the reinforcement mesh. A brown/red discolouration is often seen on old concrete slabs where the steel reinforcement members have become exposed to water and begun to rust. Ultimately, the corrosion of the reinforcement mesh will deteriorate the structural rigidity of the finished concrete panel, and if the corrosion is left untreated, the concrete panel will fail.

In some embodiments, the body of the clip may include a passageway that can receive an end section of the line wire. The passageway may be include at least a part that is a continuous perimeter wall that completely houses a section of the line wire or crosswire when inserted into the passageway. The passageway may be a partially open channel.

The body of the clip may include a channel that extends perpendicular to the passageway.

The channel may be positioned in relation to the passageway so that when the line wire is inserted into the passageway, the line wire can be rotated through 90 degrees to locate the cross-wire in and be cradled by the channel.

The passageway of the body may be perpendicular to the base.

A central longitudinal axis of the passageway may be offset from a central longitudinal axis of the channel.

The channel of the body may be positioned laterally of the passageway so that the channel does not interfere with insertion of the wire into the passageway. The channel may be of open construction to rotatably receive and retain the cross-wire. A line that bisects the base and an axis of the channel may both lie in a plane that is perpendicular to the base.

The base of the clip may comprise a tapered profile for slidably engaging the side wall. The base of the clip may be coupled to a mount. The mount may be configured to engage both the base and the side wall thereby indirectly connecting the clip to the side wall. The mount may be engageable with the base of the clip. The mount may include a cradle for slidably receiving the base of the clip.

The base, body, passageway and channel of the clip may be integrally formed.

The clip may further comprise a stiffener to support a transition between the body and the base. The stiffener may comprise a pair of legs mounted to the base in a spaced apart configuration. The stiffener may comprise a flange that transitions from the base to the body.

The body of the clip may further comprise an ear, the ear extending perpendicularly to each of the passageway and the channel. The ear may include an aperture for receiving fixings therein. The aperture of the ear may be accessible from an exterior of the reinforced concrete panel. The ear may extend from the body perpendicularly to each of the passageway and second channel in two opposing directions. An outer surface of the ear may comprise an anti-translational feature.

The terms "line wire" and "cross-wire" are understood herein to include elements that are formed from any one or more wires, rods, and bars. The elements may be single wires, bars or rods. The elements may be formed from two or more wires, rods, or bars joined to each other.

The line wires and the cross-wires may be welded together.

The formwork of the panel is capable of receiving a pourable, settable material without the need for external support members. The pourable and settable material may be a plastic, a ceramic or concrete.

The clip further provides a safety feature, by concealing the sharp ends of the line wires and cross-wires of the reinforcement mesh.

The mesh may comprise a plurality of offset reinforcing layers.

In some embodiments, the base of the clip may support a plurality of bodies extending from the base, wherein each body is configured to receive a wire from a subsequent mesh and retain each subsequent mesh in an operative position.

Where large reinforced panels are required, multiple layers of reinforcement mesh may be required to sufficiently support the finished panel. Spacer blocks may be inserted between each layer of mesh to hold the first layer of mesh and each subsequent layer of mesh at a predetermined distance from one another. However, this is time consuming and cumbersome, with no guarantee that some spacer blocks will not move around or become ill positioned. A clip providing multiple bodies for receiving and retaining mesh only requires attaching to the sidewalls once, and the clip is no longer free to move around. The distance between each body and thereby each layer of mesh is not adjustable and remains fixed in the predetermined position when transporting, orienting and pouring concrete into the preform panel.

Furthermore, the multi-body embodiment of the clip does not require a cross-wire to lock onto. It can instead be fixed in place with a swage clip, epoxy or other means. It can also be used in applications with single rods.

In some embodiments, the body of the clip may be configured to receive either a line wire or a cross-wire of the mesh and to retain the wire in any one of a number of predetermined positions relative to the other of the line wire or the cross-wire of the mesh.

The body of the clip in this embodiment provides a passageway that can receive an end section of the wire and a plurality of secondary fixing points for receiving either of a line-wire or a cross-wire. The secondary fixing points may be channels for supporting or cradles for supporting and retaining wire therein. The secondary fixing points may be oriented perpendicularly to the passageway.

The plurality of secondary fixing points may provide an adjustment mechanism for the mesh, within the preform panel. Specifically, the cross-wire of the mesh may be placed into different cradles along the body of the clip to allow different distances between the mesh and the sidewalls. As such the clip facilitates amendments to the dimensional tolerance of the preform panel.

In accordance with the present invention there is provided a method of constructing a concrete reinforced preform panel, the panel being reinforced by a mesh comprising a plurality of parallel line wires and a plurality of parallel cross-wires connected to the line wires, the method comprising the steps of: (i) engaging a plurality of clips with the plurality of parallel line wires and the plurality of parallel cross-wires of the mesh; (ii) orienting a plurality of side walls to define a perimeter around the mesh, such that each side wall partially engages a base of at least one clip; and (iii) rotating each clip to retain the wire via a twist-lock action in an operative position of the mesh.

Engaging the plurality of clips with the plurality of line wires and cross-wires of the mesh may engage a passageway of the clip to a first wire of the mesh, such that rotating the clip urges a channel of the clip into engagement with a second wire of the mesh.

The first and second wires may be oriented perpendicularly to one another.

The method may further comprise the additional step of securing a free end of each side wall to a subsequent side wall, to define a closed perimeter around the mesh.

The method may further comprise the step of introducing concrete into the preform panel.

The method may further include the step of attaching a base to the side walls enclosing the mesh within the preform panel.

According to the invention there is also provided a concrete panel comprising a side wall that defines an outer perimeter of the panel, concrete within the perimeter defining opposite top and bottom surfaces of the panel, a mesh comprising a plurality of parallel line wires and a plurality of parallel cross-wires connected to the line wires embedded in the concrete, and the above-described clip interconnecting the side wall and the mesh.

The finished panel can be used for ground-based concrete slabs, such as pathways, outdoor amenity bases and large building slabs. However, the robust reinforcement panel can also be used for walls, where the panels are formed and then tilted into position as curtain walls (also referred to as Tilt-up panels).

In some embodiments, the method further comprises the step of incorporating a base under the panel. These reinforced panels can be used for suspended concrete panel applications, such as elevated walkways, bridges and suspended floors.

The base may connect to the side walls, to form a pan. The reinforcement mesh may also be connected to the pan.

The above methods allow for fast and easy assembly of a reinforced preform panel. This in turn enables cost reductions through lower labour expenses and time savings in use. Furthermore, the simplicity of the method lends itself to use by less skilled personnel, reducing the need for training and expertise. This can also reduce the personnel required to construct reinforced concrete panels on-site.

This method is dimensionally accurate, producing consistent and robust reinforced panel slabs. The finished panel provides a consistent high quality, strong and long-lasting product.

In some embodiments, the panel may be located in the predetermined position just prior to pouring the concrete. This reduces the potential for damage of the panel from weather and transportation conditions. This reduces the number of panels that are damaged or scrapped on site, as well as reducing the opportunity for transportation damage of the panels, thereby reducing material wastage.

The method further provides reduced shipping costs as the necessary components to create the preform panels can be flat-packed for transportation.

Various features, aspects, and advantages of the invention will become more apparent from the following description of embodiments of the invention, along with the accompanying drawings in which like numerals represent like components.

BRIEF DESCRIPTION OF THE DRAWINGS

Embodiments of the invention will now be described in further detail below, wherein like reference numerals indicate similar parts throughout the several views. Embodiments are illustrated by way of example, and not by way of limitation, with reference to the accompanying drawings, in which.

DETAILED DESCRIPTION OF EMBODIMENTS

The invention will now be described more fully hereinafter with reference to the accompanying drawings, in which various embodiments, although not the only possible embodiments, of the invention are shown. The invention may be embodied in many different forms and should not be construed as being limited to the embodiments described below.

While the invention is described herein in relation to forming steel reinforced concrete panels, it is understood that a reinforcement member for the panel can be formed from various metals other than steel and numerous other materials instead of metal. It is further understood, that although concrete is a commercially viable pourable substrate from which to form a reinforced panel, other pourable materials such as plastics, resins and ceramics can also be used in keeping with the invention.

Figure 1:
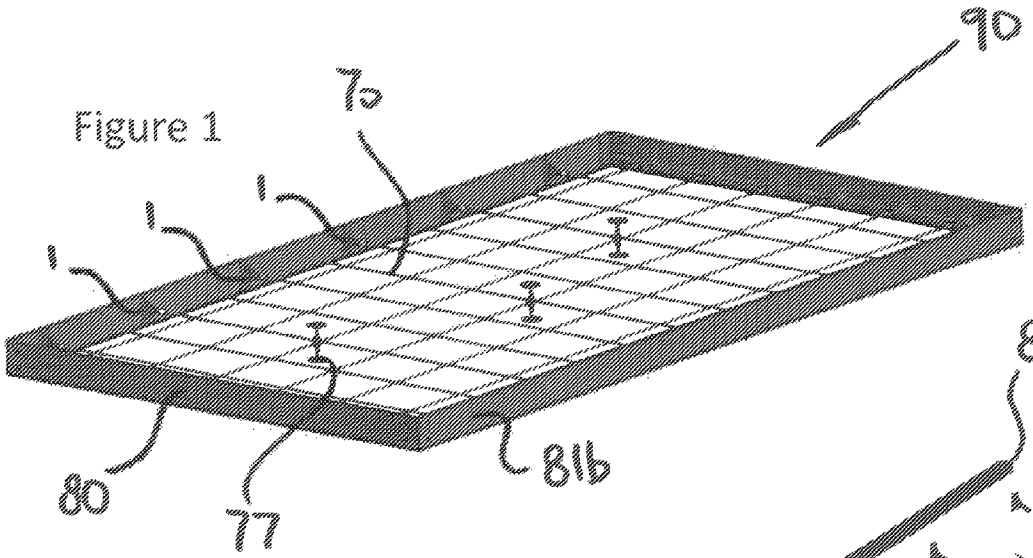
FIG. 1 is a perspective view of a preform panel according to one embodiment of the invention; The preform panel, and an exploded drawing, showing mesh, clips and formwork.
Figure 1A:
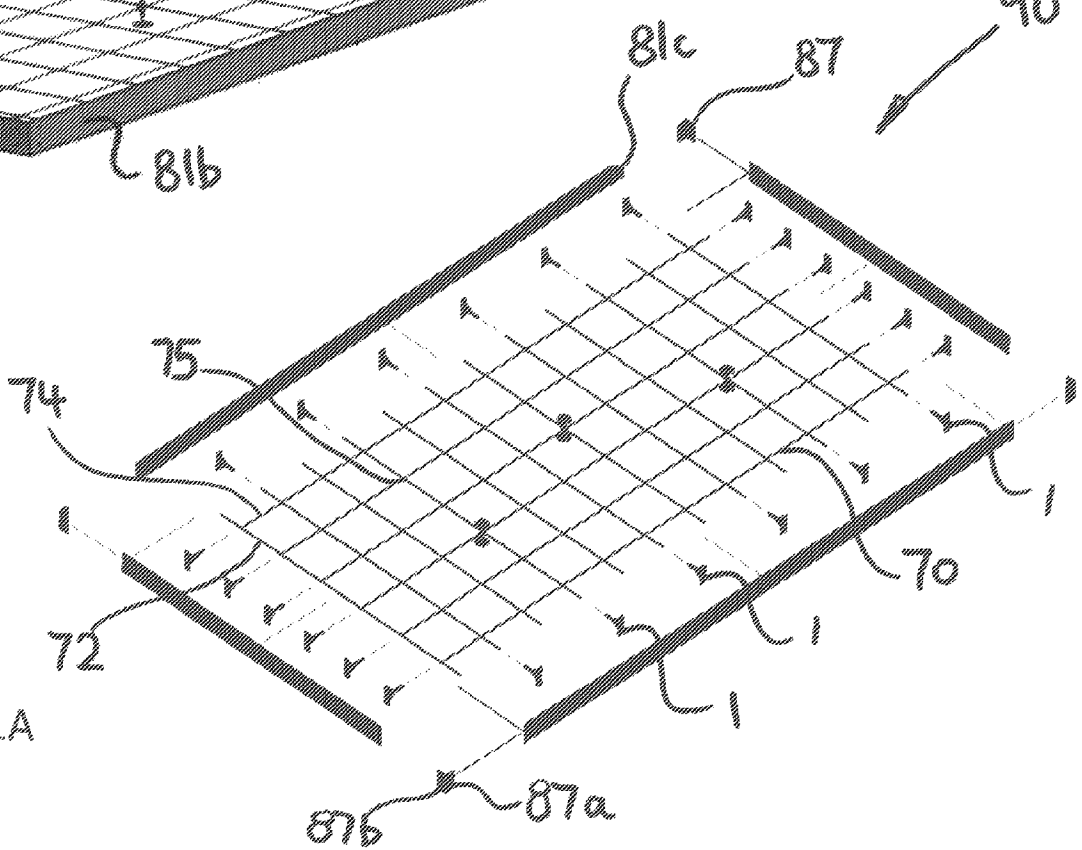
FIG. 1A is an exploded perspective view of the preform panel according to FIG. 1.

The invention provides a clip 1 for use in the construction of a reinforced concrete panel 100, the panel 100 being reinforced by a mesh 70 comprising a plurality of parallel line wires 72 and a plurality of parallel cross-wires 74 connected to the line wires 72. As illustrated in FIGS. 1 and 1A.

The clip 1 comprises a base 10 configured to engage a side wall 80 that, in use, defines a formwork 90 of the panel 100 and a body 20 extending from the base 10, the body 20 being configured to receive a line wire 72 or a cross-wire 74 of the mesh 70 and to retain the wire 72/74 in an operative position of the mesh 70.

In a first aspect of the invention, illustrated in FIGS. 1 to 4, the body 20 of the clip 1 is configured to receive the line wire 72 or a cross-wire 74 of the mesh 70 and to retain the wire 72/74 via a twist-lock action in an operative position of the mesh 70.

Figure 3:
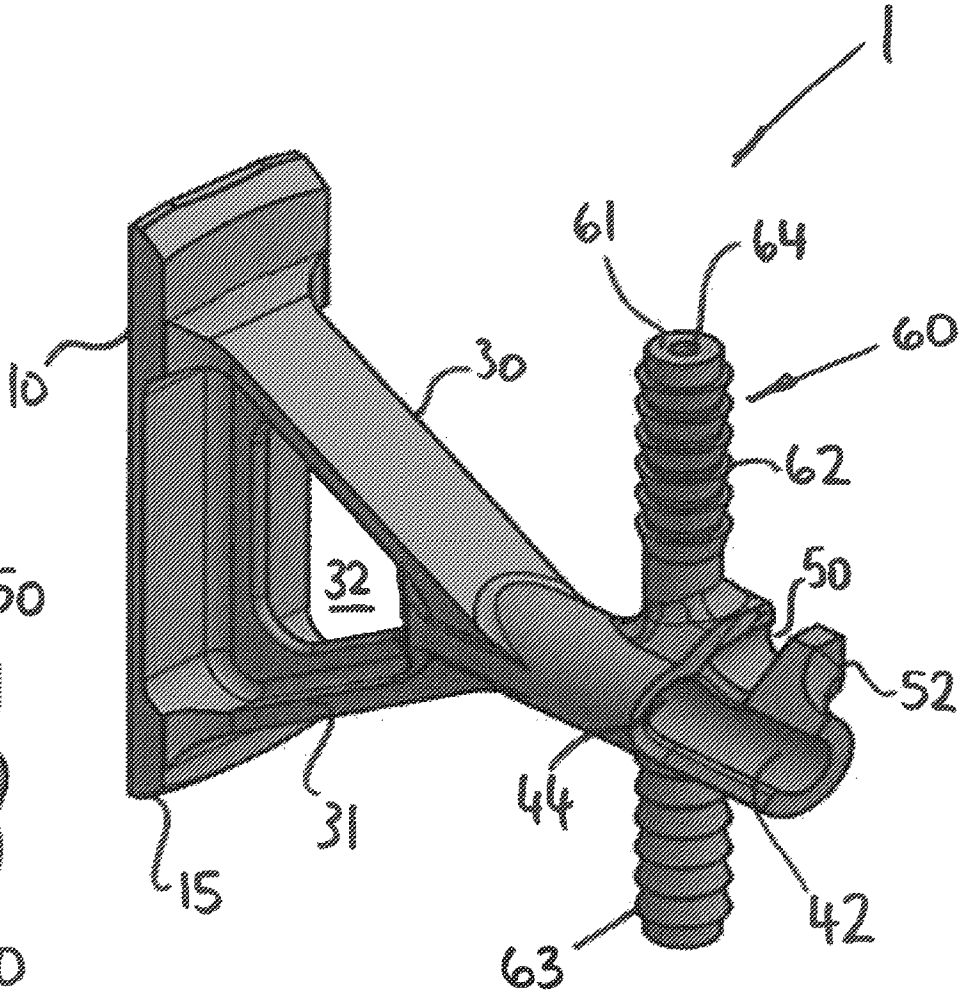
FIG. 3 is a perspective view of an alternative embodiment of a clip according the invention, illustrating plugs for easy fixing of external objects to the finished panel.
Figure 2:
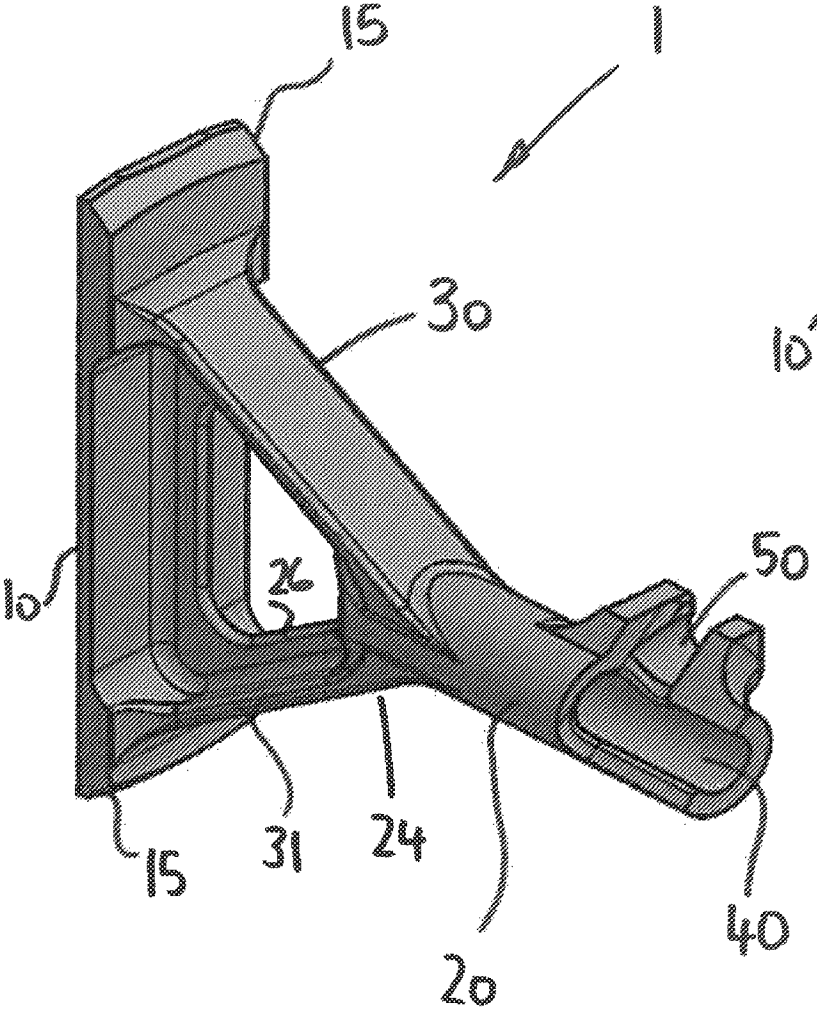
FIG. 2 is a perspective view of an embodiment of a clip according to the invention.
Figure 4:
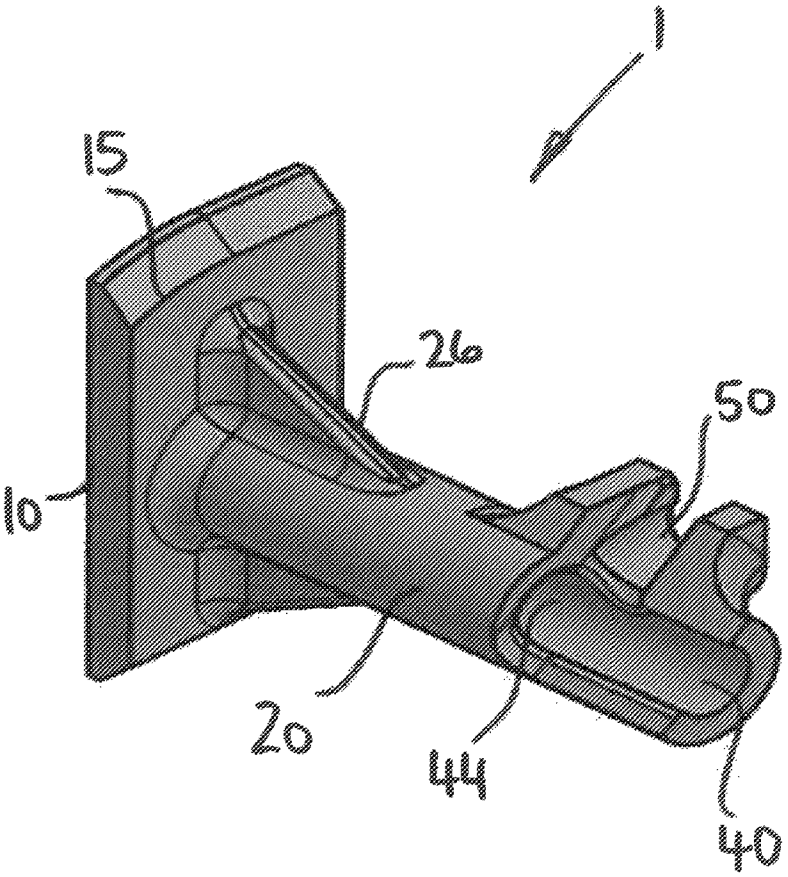
FIG. 4 is a perspective view of an alternative embodiment of a clip according the invention, illustrating a slim-line leg design and reduced length base.

With reference to FIGS. 2 to 4, the clip 1 has a rectangular base 10. Opposing ends 15 of the base 10 are tapered to facilitate engagement with the side wall 80. With reference to FIG. 1, in its simplest form, the side wall 80 is an elongate, rectangular panel. The top and bottom longitudinal edges of the side wall 80 are bent to form a planar web 81 extending between a first lip 82 and a second lip 83. The first and second lips 82, 83 are bent, to each from an acute angle with the sidewall 80 that is less than 90 degrees. The lips 82, 83 therefore, provide a V-shaped profile at opposing ends of the side wall 80, within which the tapered ends 15 of the clip 1 can be engaged. The tapered ends 15 of the base 10 can be slid into engagement with the lips 82, 83 of the side wall 80 from an end of the side wall 80, or they can be rotated into contact with the lips 82, 83 from any point along the length of the side wall 80. The side wall 80 can be made from numerous materials, depending on the application of the finished panel 100, for example: aluminium, galvanised steel, stainless steel, plastic etc. The choice of material is primarily structural. However, the choice of material will also affect the finished concrete panel 100 as the side wall 80 can effectively provide a moisture barrier around the periphery of the panel 100. The side walls 80 can be extruded, rolled, bent, moulded or the like. In an extruded form the side wall 80 can be configured to have an expansion joint (like core fluke), or tear-off strip to create a bull nose or coving shape on the top edge of the finished concrete panel 100.

The tapered ends 15 of the base 10 preferably do not extend to a point as this would form a weak point on the base 10 and leave the clips 1 prone to detachment from the side wall 80 under load. Accordingly, the tapered ends 15 are chamfered for a smooth end profile.

The clip 1 in side view has a triangular profile, the body 20 extending outwardly from the base 10 to an apex which is configured to receive the mesh 70. The body 10 is of a cylindrical shape; however, other cross-sections can be used e.g. square, rectangular, ovoid, and triangular.

At the apex of the body 20 is a passageway illustrated as a first channel 40 in FIG. 2. The channel 40 is defined by an opening extending into the body 20. The channel 40 comprises a first portion 42, which is open and a second portion 44 which is closed. The open portion 42 exhibits a C-shaped profile in cross-section. In contrast, the closed portion 44 exhibits a circular cross-section for receiving a line wire 72 or cross-wire 74 of the mesh 70. When a wire 72/74 is inserted into the closed portion 44, the clip 1 can rotate freely about the wire 72/74.

Disposed on the body 20 between the open portion 42 and the closed portion 44 of the first channel 40 is a cradle, illustrated as second channel 50 in FIG. 2. The second channel 50 is positioned laterally of the first channel 40. In the embodiment of the clip illustrated in FIG. 3, the second channel 50 is positioned perpendicularly to the first channel 40.

The second channel 50, in contrast to the open section of the first channel 40, exhibits a U-Shaped profile in cross-section. Side arms 52 of the second channel 50 extending away from the body 20 to form a cradle for receiving and retaining the wire 72/74. The opening of the first channel 40 provides a free running fit for insertion of the wire 72, 74 into the clip 1. In contrast the opening of the second channel 50 is an interference fit (also referred to as a press fit or friction fit) with the wire 72, 74 to facilitate secure engagement with the mesh 70. This interference fit between the wires 72/74 and the second open channel 50 provides a twist-lock (or snap-lock) action for securely engaging the clip 1 with the mesh 70.

The body 20 extends perpendicularly from the base 10, and as such the first opening 40 receives the wire 72, 74 perpendicularly to the base 10. The second channel 50 is perpendicular to both the base 10 and the first channel 40.

Reinforcing mesh 70 is typically formed by welding or otherwise joining a plurality of line wires 72 and a plurality of cross-wires 74, where the line wires 72 bisect the cross-wires 74 perpendicularly. Accordingly, the line wires 72 and the cross-wires 74 of a mesh 70 are rarely sitting on the same plane (unless the wires 72, 74 are sufficiently thin that the offset in their respective planes becomes negligible), they are vertically offset.

This vertical offset is accounted for in the location of the centreline of the clip 1. Because of the planar offset between the line wires 72 and cross-wires 74 of the mesh 70, the body 20 is not positioned centrally on the base 10. This would force the clip 1 to be handed, in respect of the lay-up of the mesh 70. The second channel 50 is centrally located in relation to the base 10 and the first channel 40 is offset by a diameter of the wire 72. As such, clip 1 remains symmetrically oriented to the wire within the second channel 50. A further consequence of this non-handed embodiment of the clip 1 is that the body 20 will always be offset from the centre of the base 10 by the diameter of the wire 72, 74.

The body 20 can be solid and extend perpendicularly from the base 10 as illustrated in FIG. 4. In this embodiment stiffening flanges 26 are provided to support the transition section 24 of the body 20 where it connects to the base 10. Without the flanges 26, the clip 1 could be vulnerable to bending under certain loading conditions. This provides a slim-line clip 1 variant. The base 10 has a length of approximately 50 mm in contrast to the clip of FIG. 5 which has a base 10 length of approximately 100 mm.

Figure 4B:
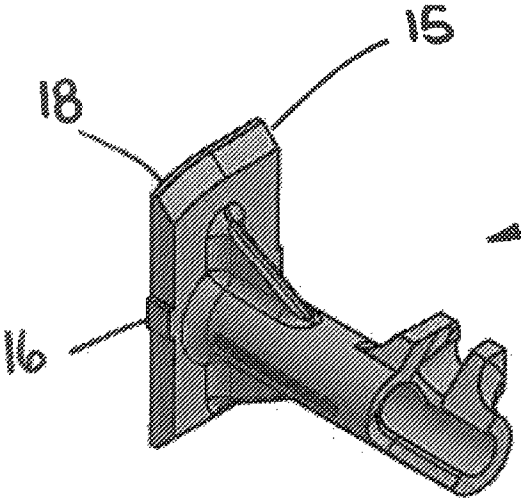
FIG. 4B is a perspective view of the clip of FIG. 4, illustrating mount engagement tabs.
Figure 4C:
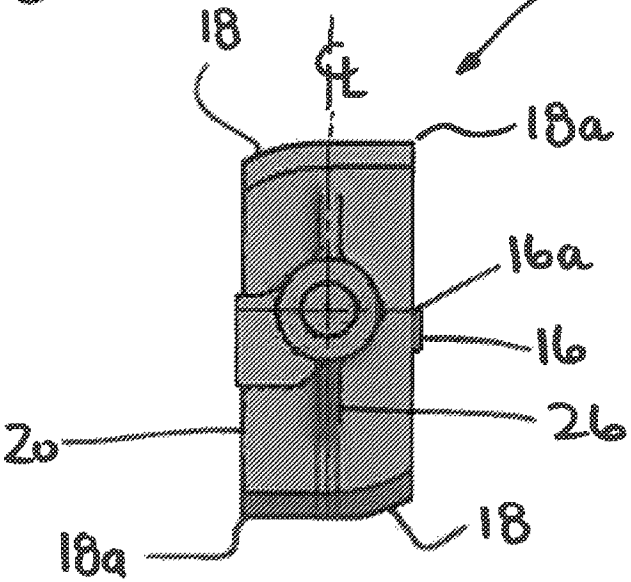
FIG. 4C is a top view of the clip of FIG. 4, illustrating a chamfered base profile.
Figure 4A:
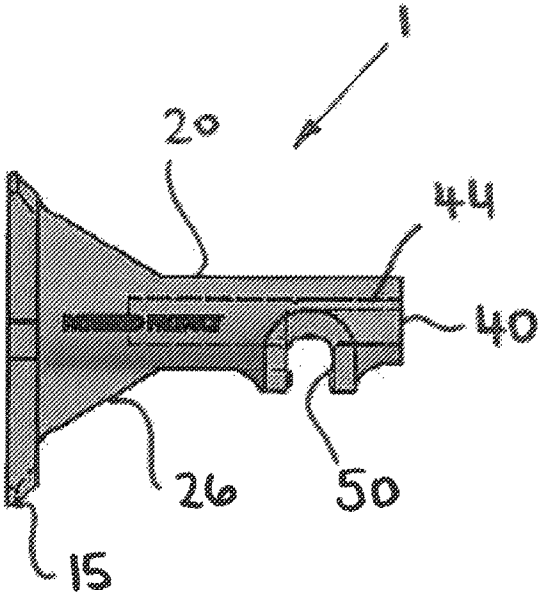
FIG. 4A is a side view of the clip of FIG. 4, illustrating an internal bore of the clip.

FIG. 4A is a side view of the clip of FIG. 4, illustrating an internal bore of the clip 1 illustrated as closed channel portion 44. This channel can have a diameter of 1 mm, 2 mm, 3 mm, 4 mm, 5 mm, 6 mm, 7 mm, 8 mm, 9 mm, 10 mm, 11 mm, 12 mm, depending on the gauge of reinforcing mesh 70 to be used in conjunction with the clip 1. Where the closed channel 44 has a diameter of 8 mm, the external diameter of the body 20 is approximately 15 mm. This then provides a wall thickness of the body 20 of about 3.5 mm. The channel 44 extends into the body 20 of the clip 20 wherein the channel 44 ceases before the base 20. The channel 44 can extend between 20 to 50 mm into the clip body 20; however, if the channel 44 continues towards the base 10 a loss of lateral stiffness can occur.

On opposing sides of the base 10, in a longitudinal direction of the clip 1, there are provided engagement tabs 16, illustrated in FIG. 4B. These tabs 16 protrude centrally from the sides of the base 10 by 1-3 mm, to enhance engagement and/or locate the clip 1 when engaged with a connector 35 (see FIG. 6A). The engagement tabs 16 are mounded into the form of the clip during manufacture. The engagement tabs 16 extend across the full depth of the base 10; however, it is contemplated that they could be configured to only partially extend the depth of the base 10 or further, that they could be shaped to cooperate with the form of the connector.

The tabs 16 are clearly illustrated in FIG. 4C, a top view of the clip 1. The opposing corners of base 10 are rounding, providing a pair of chamfered corners 18. This is in stark contrast to the remaining corners 18*a* which are right-angled, when viewed from above. The chamfered corners 18 are curved with a radius between 20-30 mm. This shaping of the base 10 provides an anti-rotation feature, such that when clip 1 is placed adjacent the upper lip 82 and lower lip 83 of the side wall 80, the clip 1 is easily rotated into engagement with the lips 82, 83 in an anti-clockwise direction, but will not rotate into engagement with the lip s 82, 83 in a clockwise direction. As such the clip 1 can be considered to be handed. It is contemplated that the clip 1 can be configured left or right handed (anti-clockwise locking or clockwise locking).

The centre of closed channel 44 is not symmetrically aligned with the base 10, as clearly illustrated in FIG. 4C. The centre of channel 44 aligns with a first end 16*a* of the engagement tab 16. The tab 16 extends along the length of the base 15 by approximately 6 mm. As such the body 20 of the clip 1 is 3 mm offset from the longitudinal axis of the clip 1 (although central in a transverse axis of the clip 1). This non-symmetry allows the clip to be engaged with the side wall 80 in two orientations 180 degrees opposed to each other. The two orientations will vary the offset of the reinforcement 70 from the edge of the finished panel 100 by 3 mm. As such, the clip 1 can be oriented to increase the depth into which the reinforcement 70 is embedded.

The embodiment of the clip 1 illustrated in FIG. 2 also provides a transition section 24 between the base 10 and the body 20, comprising a pair of spaced apart legs 30. The legs 30 provide a structural stiffening feature of the clip 1. Some form of stiffener is advantageous as the clip 1 will be supported at the base 10 in the side wall 80, whereas the loading on the clip 1 will be introduced in multiple directions to the apex of the body 20, namely first channel 40 and second channel 50. Accordingly, the length of the clip 1 provides an offset between the base 10 and apex, increasing rotational loading on the clip 1. The clip 1 can be manufactured in individual pieces such that the base 10, body 20 and channel 40, 50 must be assembled before use. Alternatively, the base 10, body 20 and channels 40, 50 can be integrally formed.

When formed as separate components, there is no requirement that each component is manufactured from the same material. This provides a way of tailoring the clip 1 for bespoke applications and moving the structural strength of the clip 1 to localised areas where high load resistance is required.

For integrally formed embodiments of the clip 1, plastics are ideally suited as the construction material. First, they can be tailored with reinforcements and additives for particular applications. Secondly, plastics lend themselves to high volume manufacture, whether cast, injection moulded, vacuum moulded or thermoformed. Thirdly, plastic materials are not prone to corrosion and provide the requisite degree of resilience to compensate to the breathing of the finished concrete panel (the expansion and contraction cycles that concrete is subjected to by weather and other environmental factors).

Excess material is removed from the transition section 24 of the body 20 resulting in an aperture 32 centrally positioned between the legs 30 of the clip 1. This provides a weight saving for each clip 1 and more efficient material use. The leg 30 further provides a peripheral flange 31 forming an I-Shaped cross-section of each leg 30.

The clip 1 can also be configured with additional functionality, particularly where connections are desired between the finished concrete panel 100 and an external object. For example, the clip 1 can be configured to provide a fixing point or a plurality of fixing points to connect to the finished panel 100.

The clip 1 of FIG. 3 illustrates a pair of ears 60 extending in opposing directions from the body 20. The ears 60 are aligned with the base 10 and thus extend away from the body 20 in a direction perpendicular to both the first channel 40 and the second channel 50. The pair of ears 60 extend to a length equal to that of the base 10, such that an end face 61 of each ear 60 is accessible in the finished concrete reinforced panel 100. The ears 60 thus provide a mounting point for attachments to the finished panel 100.

The ears 60 can be formed with a central opening 64 for receiving standard fixing such as nails, screws, pins etc. The opening 64 further provides a through aperture from one side of the finished panel 100 to the other. This can be used for locating cables and wires through the slab.

An outer surface 62 of each ear has an anti-translational feature, illustrated in FIG. 3, as a series of teeth 63 that reduce the amount of movement of the clip 1 within the slab 100. The teeth 63 also increase the frictional resistance between the concrete and the ears 60 when using them as fixing points. The teeth 63 of each ear 60 are oriented in opposition to one another to balance the loading onto the clip 1 from either side of the panel 100.

Once integrated into the finished panel 100, the attachment points/fixing points provided by ears 60 can be used to affix things to the panel 100 and can also be used to affix the panel to the ground or other nearby structure. For tilt-up panel 100 applications, a connection point can be made between the tilt-up panel 100 and the foundation (ground where the panel 100 is formed), to assist in lifting the panel 100 up to its vertical installation orientation.

The connection points can be used to enable easy removal of the completed concrete panels 100 for maintenance and replacement. For example, pathways where a pavement is impinged by tree roots. The connection points can be used to raise the finished panel 100 providing access to the problematic tree roots and then the panel 100 replaced or refitted.

The clips 1 can be mass produced to be identical. They are dimensioned to co-operate with standard gauge reinforcement mesh 70. The mesh is manufactured to be dimensionally accurate; however, the edges where the mesh 70 is cut to size on site can lead to dimensional fluctuations.

When the mesh 70 is inserted into the clip 1, the engagement point of the clip 1, channels 40, 50, rely on the cross-over point 75 between line wire 72 and cross-wire 74 on the mesh 70. This is a dimensionally controlled point on the mesh 70. Accordingly, even when the edges of the mesh 70 have been poorly cut, the clip 1 will engage with the cross-over point 75 reducing the opportunity for the formwork 90 and thus the finished panel 100 to be skewed or outside of dimensional tolerance.

Figure 5:
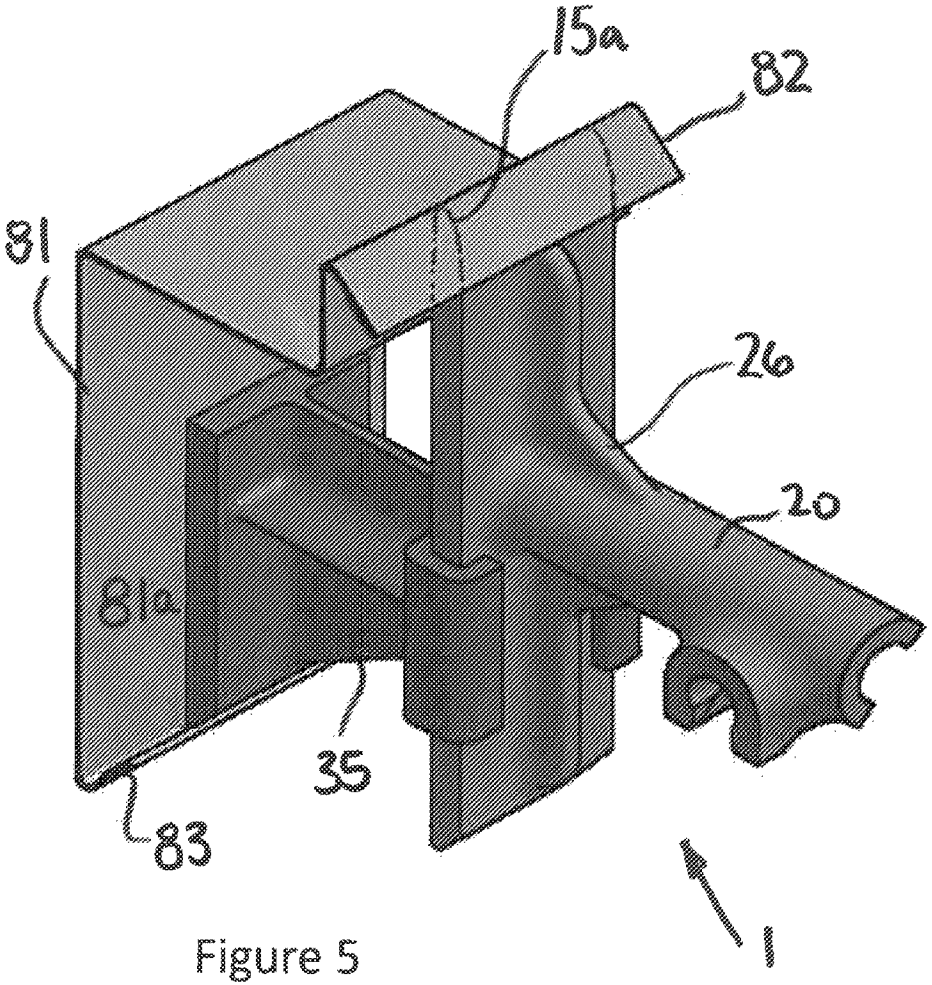
FIG. 5 is a perspective view of the clip aligned for use with a single mount to form a two-piece clip arrangement.
Figure 6:
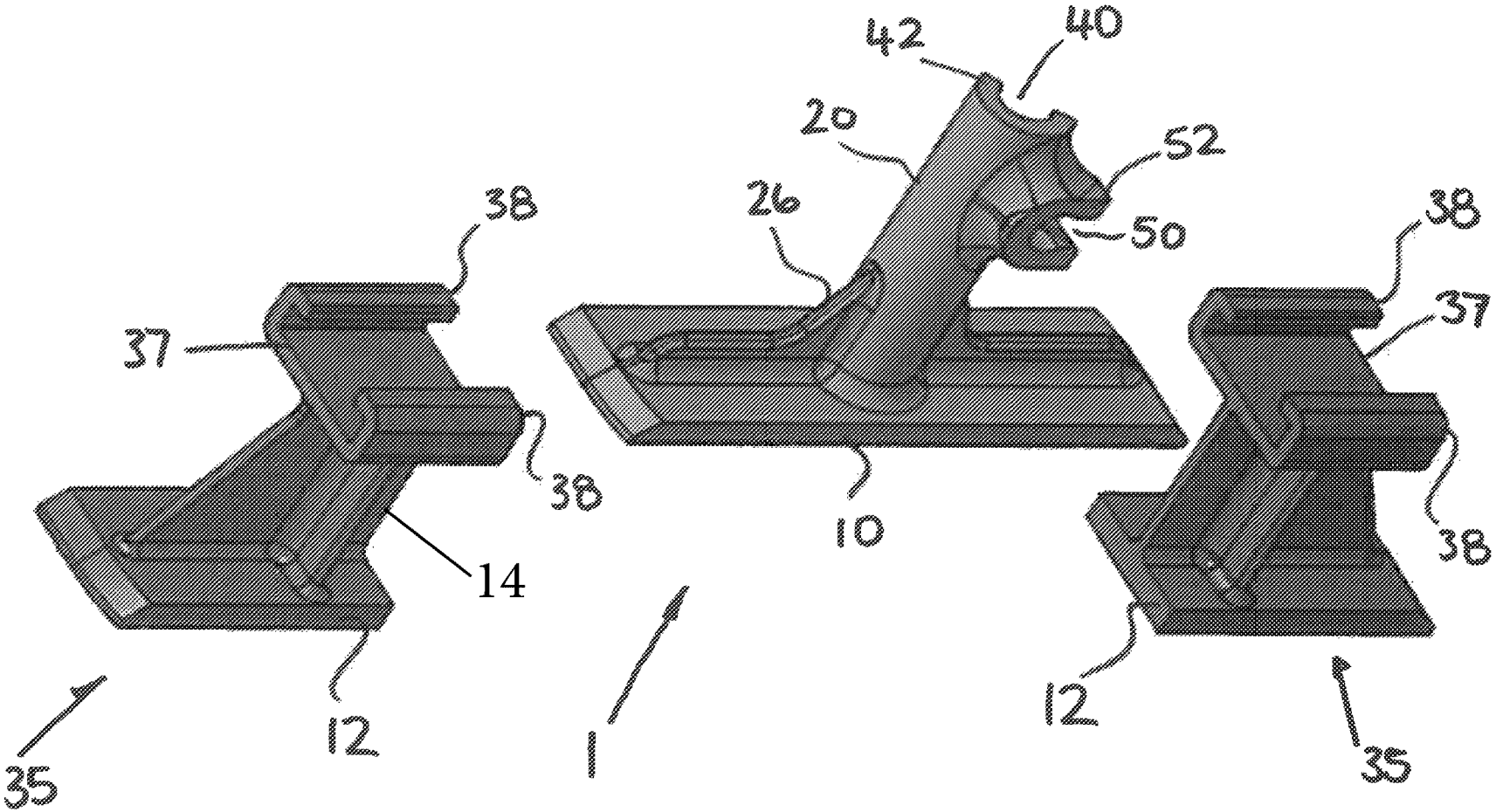
FIG. 6 is an exploded perspective view of the clip aligned for use with two symmetrical mounts to form a three-piece clip arrangement.

To provide additional flexibility of use, the clip 1 is configured to work in conjunction with a mount, illustrated in FIGS. 5 and 6 as a connector 35. The connector 35 is provided with a base 12 for engagement with the side wall 80. Supported on a stem 14 and offset from the base 12 is a support channel 37, for sliding engagement with the clip 1. The support channel 37 has a C-shaped cross section defining a pair of arms 38, into which the base 10 of the clip 1 can be slid. Accordingly, the connector 35 facilitates use of the clip 1 to engage with non-standard side wall 80 profiles.

The pair of arms 38 slidably grip opposing sides of the base 10 of the clip 1. The pair of arms 38 is dimensioned to provide an interference fit with the base 10, such that the clip 1 is frictionally held in place in the support channel 37 and requires external force to push the clip 1 through the channel 37. The translation between the clip 1 and the support channel 37 allows the base 10 of the clip 1 to effectively be extended by use of the connector 35, as illustrated in FIG. 5. In FIG. 6, two identical connectors 35 are illustrated in alignment with the clip 1. This configuration allows the base 10 of the clip 1 to be effectively extended in two opposing directions for use with different sizes of side wall 80.

FIG. 5 illustrates the clip 1 engaged with a side wall 80 via a single connector 35, which is located just below a midway point on the base 10. In this configuration a first tapered end 15*a* of the base 10 of the clip 1 is tensioned in combination with the base 12 of the connector 35 to secure the clip 1 to the sidewall 80.

It will be appreciated that numerous configurations of the clip 1 and a connector 35 or plurality of connectors 35 can be used to secure the clip 1 to the side wall 80.

Figures 6A, 6B, 6C:
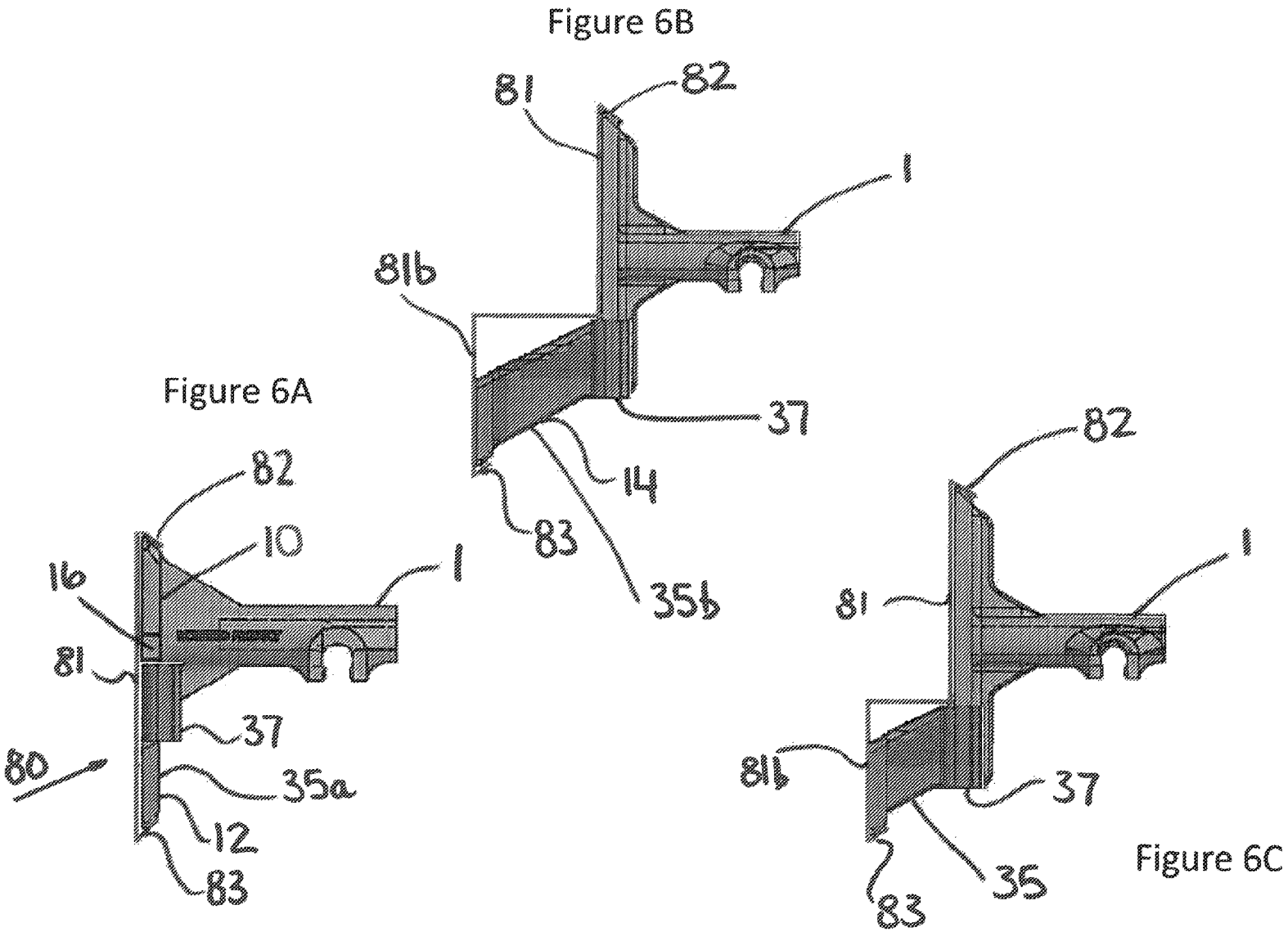
FIG. 6A is a side view of the clip of FIG. 4 engaged with an extension mount.
FIG. 6B is a side view of the clip of FIG. 5, engaged with an offset mount for engaging a deep-rebated side wall.
FIG. 6C is a side view of the clip of FIG. 5, engaged with an offset mount for engaging a narrow-rebated side wall.

FIGS. 6A to 6C illustrate some of the contemplated configurations of clip 1 and connectors 35.

FIG. 6A illustrates a 50 mm clip 1 that is extended by 25 mm to allow the clip 1 to sit flush against the planar web 81 of the side wall 80 and to engage the tapered end 15 with lip 82, while the extension connector 35*a* engages the lower lip 83 of the side wall 80 to hold the clip 1 in position. Extension connector 35*a* has similar support channel 37 to that of connector 35. Connector 35 has not stem 16, such that the channel 37 for gripping the clip 1 is not offset from the base 12. The base 10 of clip 1 is slid into the channel 37 such that the pair of arms 38 adjacent the body 20 of the clip 1 abut the engagement tab 16.

FIG. 6B illustrates and alternative connector 35*b* having an extended stem 14. In this embodiment the stem is approximately 40 mm in length. The connector 35*b* has the same base 12 and channel 37 for engaging the clip 1. As only a single connector 35*b* is engaged with the clip 1 (in contrast to the arrangement of FIG. 6), the clip 1 and connector 35*b* can engage a rebated side wall 80, having an upper web 81 and a lower web 81*b* that is 40 mm offset (rebated) from the upper web 81. The connector can be manufactured in a number of standard sizes to dimensionally complement variations of side wall 80. FIG. 6C illustrates the connector 35 of FIG. 6 used singularly (as opposed to in pairs), and having a 20 mm stem to accommodate a 20 mm rebated side wall 80.

As alternative combinations, the clip 1 having a 100 m base can be extended to engage a 150 mm side wall by engaging two connectors 35*b* to opposing ends of the base 10. Two connectors 35*b* having 40 mm stems can also be attached to opposing ends of the slim-line clip (50 mm base) to extend the base 10 to engage a 100 mm side wall 80 (see FIGS. 6D and 6E).

A further advantage of using the connectors 35, 35*b* in combination with the clip 1, is that a swage or similar form in the side wall 80 can be accommodated. Swages provide a stiffening feature to the planar web 81, although this swage is only required to strengthen the side wall 80 until concrete or other pourable substrate is introduced. The clip 1 has a planar base 10 and as such will not attach securely to a side wall 80 having an inward extending swage or protrusion. From a strength perspective, a swage or protrusion in the side wall 80 can be configured to extend outwardly (away from the clip 1) however, any protruding features from the side walls 80 could create safety or storage issues.

Figure 6E:
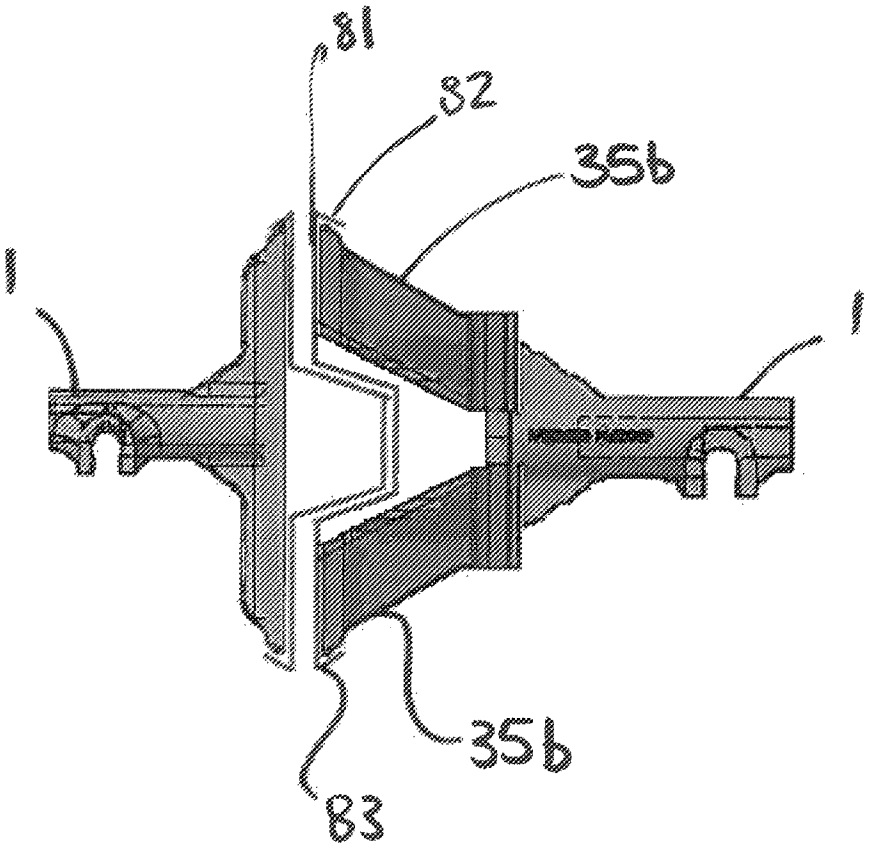
FIG. 6E is a side view of a two-sided joint where a clip of FIG. 5 and a clip of FIG. 4 are engaged with opposing side walls, the side walls both having a central swage, illustrating how the clips can be configured to straddle the swage.
Figure 6D:
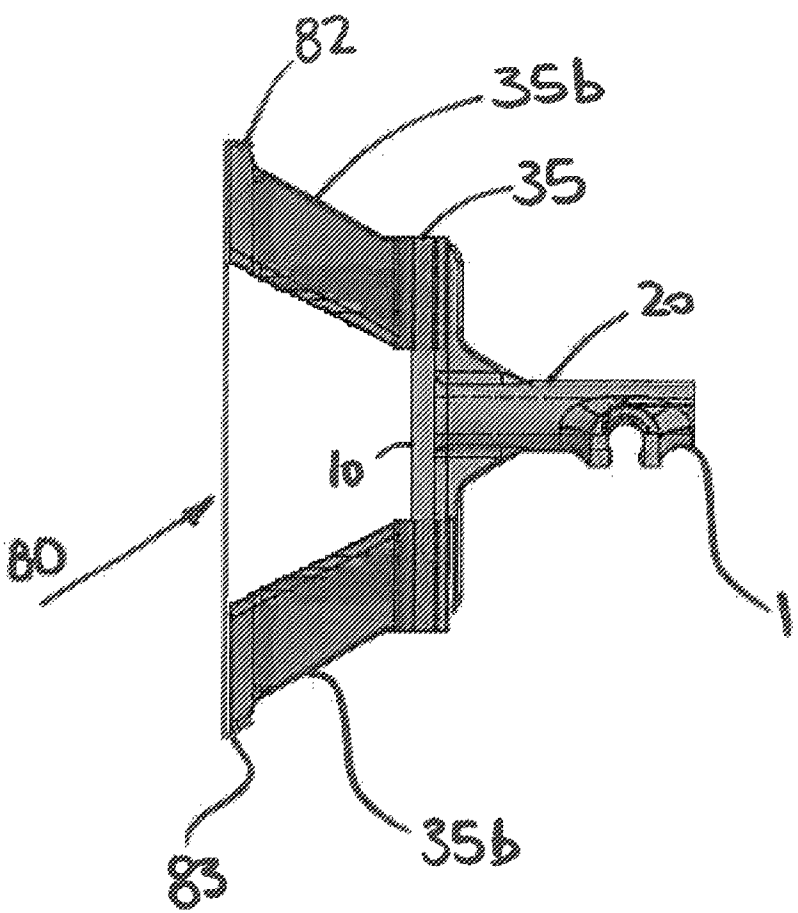
FIG. 6D is a side view of the clip of FIG. 5, engaged with a pair of offset mounts for engaging a side wall with greater depth that the clip.

The embodiments of FIGS. 6-6E are provided merely as examples. In reality, numerous combinations of clips and connectors can be engaged to provide a highly flexible solution to a variety of dimensionally varied applications.

When smaller dimensioned panels 100 are being constructed there may not be a need for bar chairs 76, 77. The use of the clips 1 provide perimeter spacers that ensures the reinforcement mesh is maintained in an operative position within the formwork 90. Ideally any steel reinforcement should be kept a minimum distance, e.g. 40 mm, away from an external surface of the concrete slab 100, to ensure that any water permeating the panel 100 surface does not contact the reinforcement mesh 70 and initiate corrosion thereof. In this manner the reinforcement mesh 70 can be fitted with perimeter clips 1 and laid into a mould such that the clips provide a spacing means for supporting the mesh 70 at an operative position within the mould.

Lightweight Side Wall Clip

In a second aspect of the invention there is provided a clip 101 for use in the construction of a reinforced concrete panel 100, the panel being reinforced by a mesh 170 comprising a plurality of parallel line wires 172 and a plurality of parallel cross-wires 174 connected to the line wires 172, the clip 101 comprising: a base 110 configured to engage a side wall 180 that, in use, defines a formwork 190 of the panel 100; and a body 120 extending from the base 110, the body 120 being configured to receive a line wire 172 or a cross-wire 174 of the mesh 170 and to retain the wire in an operative position of the mesh 170.

The mesh 170 may comprise a plurality of offset reinforcing layers (170'). In this aspect of the invention, the clip 101 is configured to slidably engage an inner face 181 of the side wall 180. The side wall 180 is provided with a pair of mounting rails 185 into which the clip 101 is inserted.

Figures 7, 8:
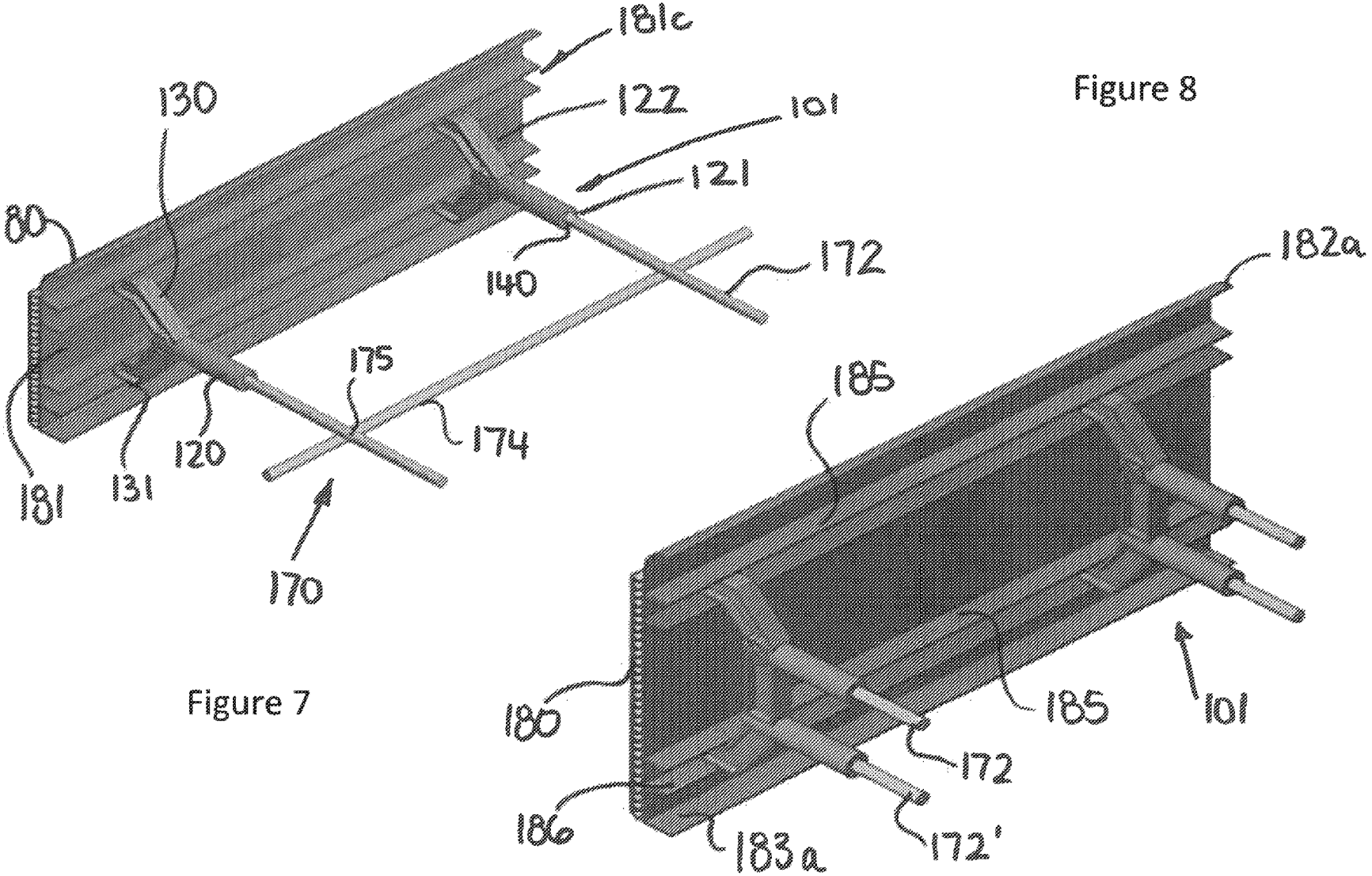
FIG. 7 is a perspective view of a lightweight formwork mounted to a push-on clip configuration.
FIG. 8 is a perspective view of a double-bar clip embodiment, for use in preform panels to construct thick slabs having two sheets of reinforcement mesh.

Illustrated in FIG. 7, the clip 101 has a body 120 with a first channel 140 at a first end 121, for receiving a line wire 172 of a cross-wire 174 of a reinforcing mesh 70. An opposing, second end 122 of the body 120 comprises a pair of legs 130 that engage with the mounting rails 185 of the side wall 180. In side view the clip 101 has a Y-Shaped profile.

As with clip 1 described herein, the body 120 and legs 130 of the clip 101 can be integrally formed from a resilient material such as a plastic or reinforced plastic.

The leg 130 has an I-Shaped cross-section to provide structural stiffness and efficient material usage. Accordingly, each leg 130 effectively has a perimeter flange 131 to stiffen each leg 130 and resist bending forces applied to the clip 101 by the mesh 170 and side walls 180.

Figures 9, 9A, 9B:
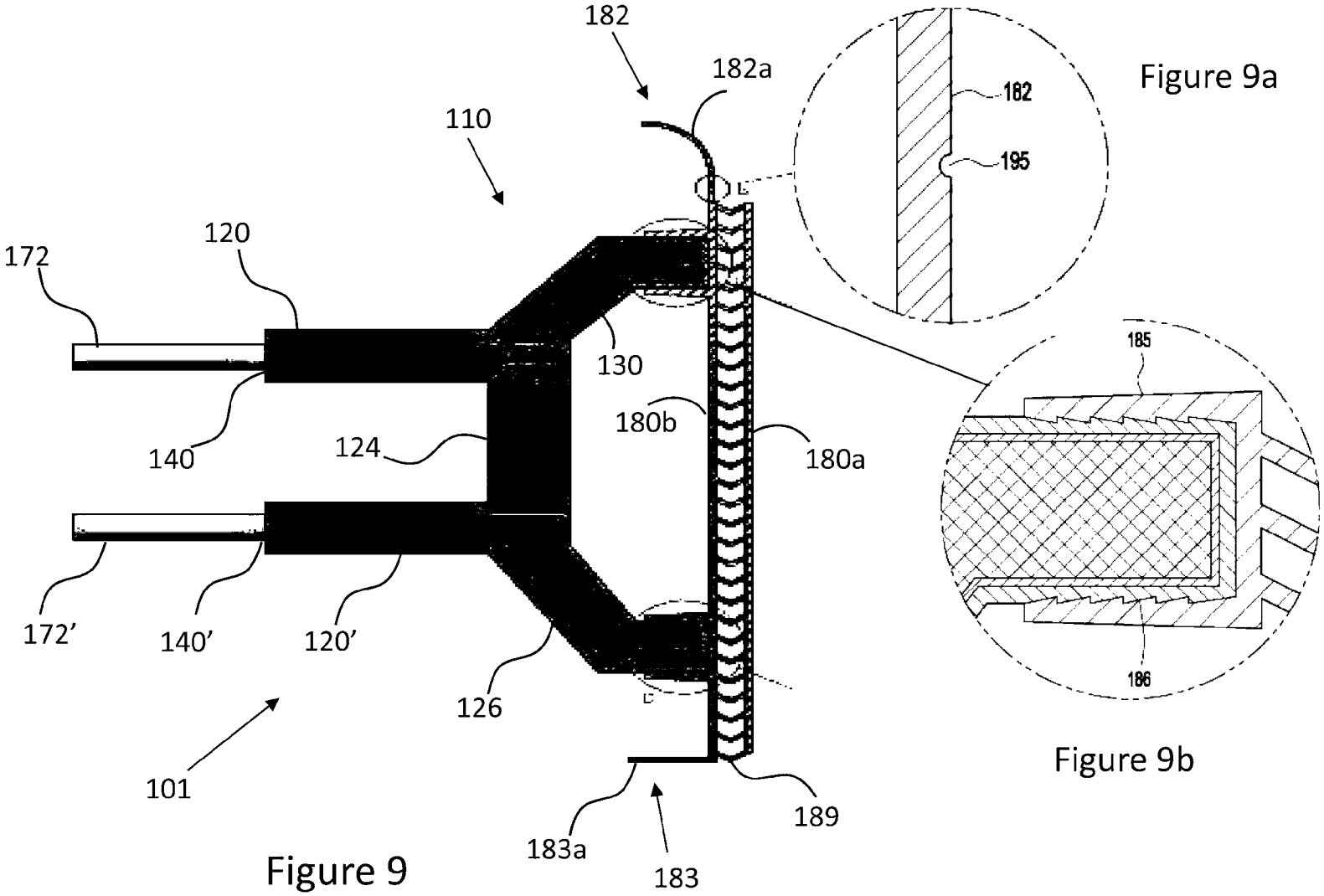
FIG. 9 is a side view of the double-bar clip of FIG. 6, illustrating an engagement method between the clip and a side wall.
FIG. 9*a* is an enlarged view of encircled area B of FIG. 9, illustrating a notch in an upper lip channel attached to a contoured inner face of the side wall such that the upper lip can be removed to expose a smooth concrete finish.
FIG. 9*b* is an enlarged view of encircled area C of FIG. 9, illustrating a series of retaining barbs on the contoured inner face of the sidewall for retaining the clip.

Illustrated in FIGS. 8 and 9 is a double-mesh 170 carrying embodiment of the clip 101. This clip 101 supports two layers of mesh 170 in an operative position with the finished panel 100. Furthermore, the clip 101 maintains a predetermined offset between each layer of mesh 170 for optimum structural support. The clip 101 includes two bodies 120 symmetrically mounted on a single pair of legs 130. Each of the two bodies 120 comprising a first channel 140 to receive a line wire 172 or a cross-wire 174 therein. The mesh 170 in an operative position is oriented perpendicularly to the clip 101 and perpendicularly to the side wall 180.

The side wall 180 for use with clip 101 is of a lightweight construction. The side wall 180 comprises two thin wall layers 180*a*, 180*b* interconnected by a plurality of internal reinforcements, illustrated in FIG. 9 as chevrons 189. The chevrons 189 provide stiffness to the pair of wall layers 180*a*, 180*b* without adding unnecessary mass to the side wall 180.

The chevron internal reinforcements 189 provide a further advantage (see FIGS. 9 and 21) wherein the chevrons 189 provide a compressible portion of the side wall 180. Whether the side wall 180 is used alone or disposed adjacent a subsequent side wall 180 (FIG. 21) the compressible nature of the wall 180 accommodates the expansion and contraction of the concrete within the finished panel 100 such that the side walls 180 are not damaged or fractured when exposed to changes in temperature and humidity. The distance between the wall layers 180*a* and 180*b* is approximately 5.5 mm thereby providing about 3 mm of movement between the side walls 180*a*, 180*b* under compressive loading.

The side wall 180 further comprises an upper lip 182 and a lower lip 183. The upper lip 182 provides a curved corner shield 182*a* and a mounting rail 185 for receiving the clip 101. The upper lip 182 can be integrally formed with the side wall 180 of formed separately in long lengths for affixing to the side wall 180. When formed separately, the upper lip 182 lends itself to extruded or roll formed construction or moulding.

Upper lip 182 provides a frangible portion of the sidewall 180 that can be easily removed. The frangible portion is illustrated in FIG. 9*a*, wherein the base of curved corner shield 182*a* has a notch 195, so that once the concrete mix has set within the formwork 190, the curved corner shield 182*a* can be detached and easily removed from the remainder of the side wall 180, exposing a rounded concrete corner to the finished panel 100.

The lower lip 183 provides a planar corner shield 183*a* and a mounting rail 185 for receiving the clip 101. The lower lip 183 can be integrally formed with the side wall 180 or formed separately in long lengths for affixing to the side wall 180. When formed separately, the lower lip 183 lends itself to extruded or roll formed construction or moulding.

Figure 10A:
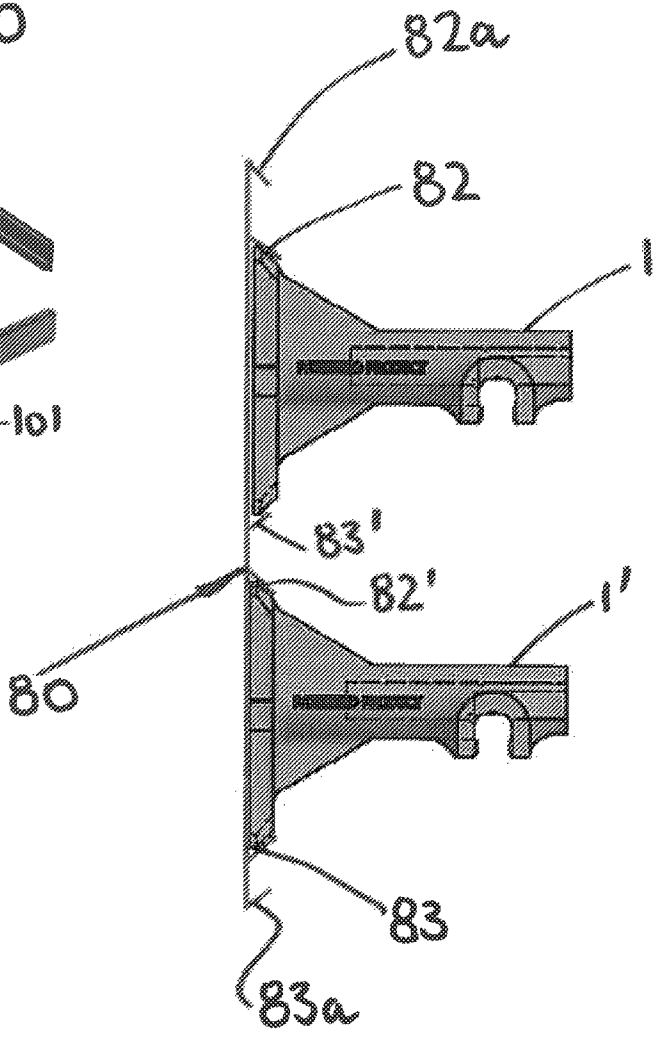
FIG. 10A is a side view of a double mesh arrangement using the clips of FIG. 4, for supporting multiple layers of reinforcement within a perimeter formwork.
Figure 10:
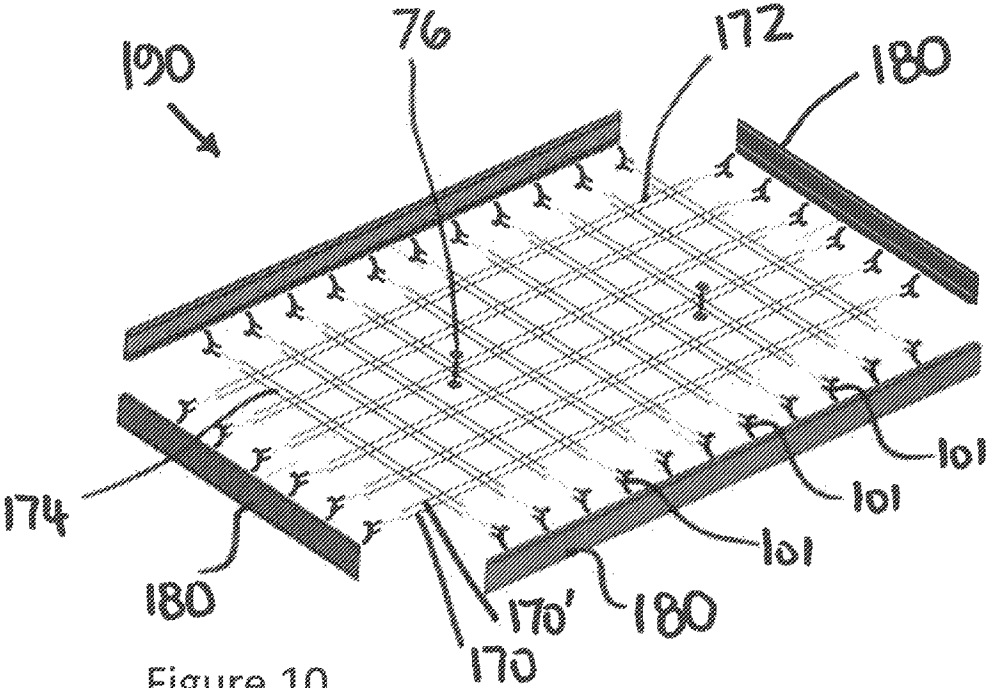
FIG. 10 is an exploded perspective view of a preform panel comprising double-bar clips according to those of FIG. 7.
Figure 14:
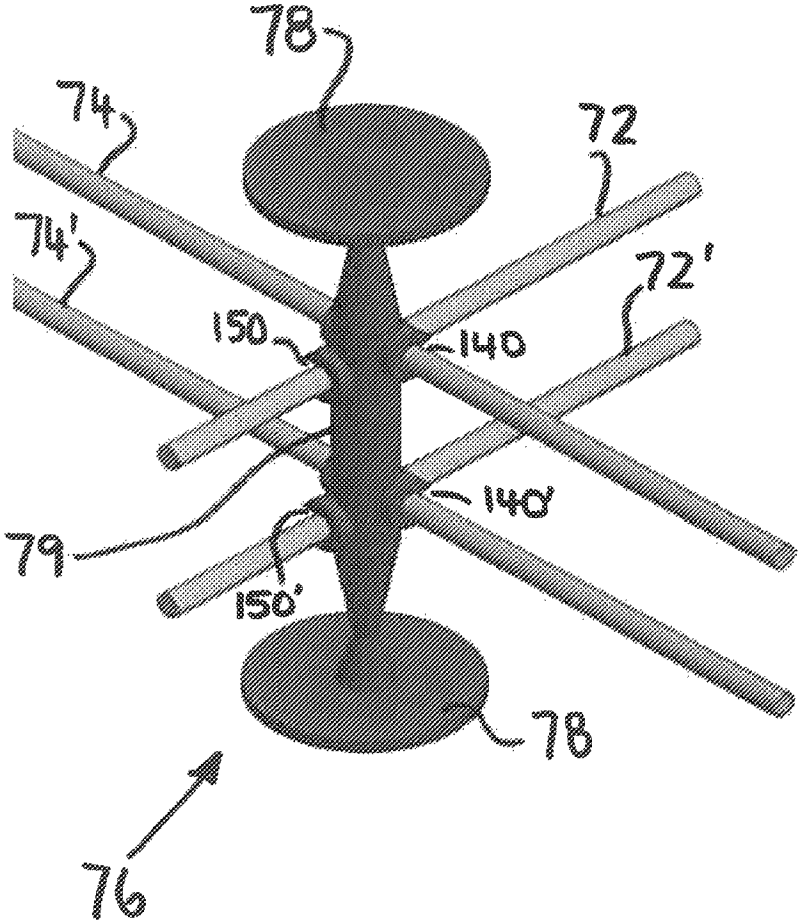
FIG. 14 is a perspective view of double-mesh bar chair, to support double layers of mesh at a constant height and provide a level for concrete finishing and for stacking and packaging of a finished slab.
Figure 13:
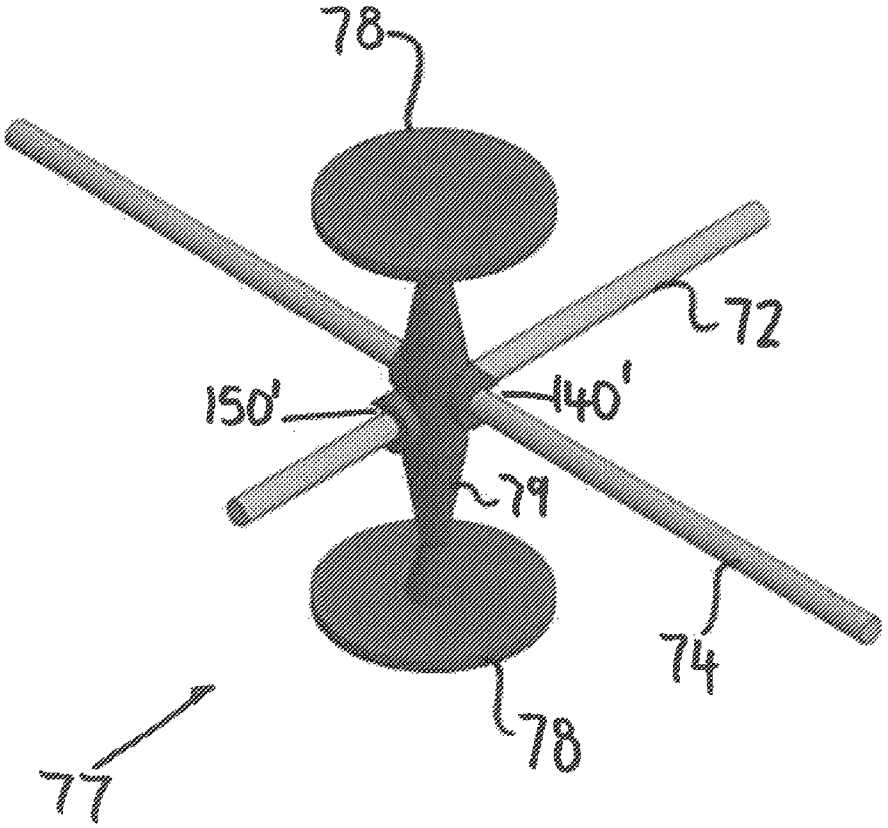
FIG. 13 is a perspective view of a single-mesh bar chair, which provides a level for concrete finishing and for stacking and packaging of a finished slab.

The mounting rail 185 is of a U-shaped section, having an open end for receiving the leg 130 of the clip 101. The mounting rail 185 further provides an internal retention feature for engaging and securing the leg 130 therein. In FIG. 9*b* the retention feature is illustrated as a series of barbs 186. These barbs 186 resist removal forces ie. a pulling force separating the clip 101 from the side wall 180. However, the barbs 186 do not hamper the clip 101 from being slid along the mounting rails 185 for repositioning. Accordingly, clip 101 can be snap-on and slid into place on the side wall 180. This allows the clip 101 to be attached at the end of each side wall 180 section or attached directly to a desired location along the length of the side wall 180.

Where double layered mesh 170 is used, the mesh 170 can be further reinforced by the use of spacers, illustrated in FIGS. 10 and 14 as a double bar chair 76. A single bar chair 77 can also be used to support larger formworks 90, illustrated in FIG. 13.

Both the single 77 and double bar chair 76 are configured to receive a cross-over portion 175 of the mesh 170. Both bar chairs 76, 77 include a body 79 extending between a pair of bases 78. The bases 78 are positioned to align with the outer faces of the finished panel 100, defining the depth of the finished panel 100.

Centrally of the body 79 the bar chair 77 provides a first channel 140' and a second channel 150' (similar to those of clip 1) configured to receive a line wire 172 or a cross-wire 174 of the mesh 170 and to retain the wire 172/174 via a twist-lock action in an operative position of the mesh 170. The double bar chair 76 comprises a duplicate set of first and second channels 140', 150' for receiving a second layer of mesh 170. Additional sets of channels can be provided on the bar chair 77 for supporting additional layers of mesh 170.

To allow the bar chair 76, 77 to twist-lock, the cross-over portion 175 of the mesh 170 is only supported on three of its four sides.

When two layers of mesh 170 are used, a bottom mesh 170 is assembled to the formwork 190 first, clipping into the side wall 180, followed by a second mesh 170 layer.

FIG. 10A illustrates an alternative embodiment of the invention, comprising two layers of reinforcing mesh 170, 170' to be supported within the formwork 190. The side wall 80 provides a pair of upper lips 82, 82' and a pair of lower lips 83, 83'. All of the retaining lips for engaging the bases 20 of the pair of clips 1, 1' are inset from the corner shields 82*a*, 83*a* of the side wall 80. The lips 82, 83 are positioned to place the reinforcing mesh 170, 170' sufficiently within the side wall 80, such that when concrete is poured into the formwork 190, a predetermined thickness of concrete sets around the mesh 170, 170'. This helps to avoid exposure of the mesh to water. When the finished panel 100 is exposed to water some of the water will permeate the outer surface of the finished panel 100, this permeation will make the mesh 170 vulnerable to corrosion (rusting) if there is not a sufficient depth on concrete around the mesh 170. The required depth of concrete around the mesh 170 will be subject to different standards depending on country, region and purpose for which the finished panel 100 is to be used. More than two layers of mesh 170 can be engaged with the side walls of the formwork 190 in alternative embodiments of the invention.

The corner shields 82*a*, 83*a* are angled inwards, such that when a pourable or curable substrate is introduced into the formwork 90 the shields 82*a*, 83*a* become encased within the cured substrate eg. concrete or cement. This neatly hides the shields 82*a*, 83*a* for an improved aesthetic of the finished panel 100 and further reduces protrusions on the finished panel 100 that could snag or foul nearby people or objects.

Vertical Panel Construction Clips

Concrete panels 100 to be used for vertical walls can be referred to as "tilt-up panels". In these embodiments, an aperture is often required in the finished panel 100 for windows, doors and other domestic features ie. ducts and the like. Although any required apertures can be cut from the finished panel 100 this is wasteful of the concrete material and also requires additional work time and labour to execute the cutting process. It is also difficult to cut small holes accurately in concrete without specialised cutting equipment. Accordingly, it is useful to be able to mark-out voids within the formwork 90 prior to pouring of the concrete.

Figure 11:
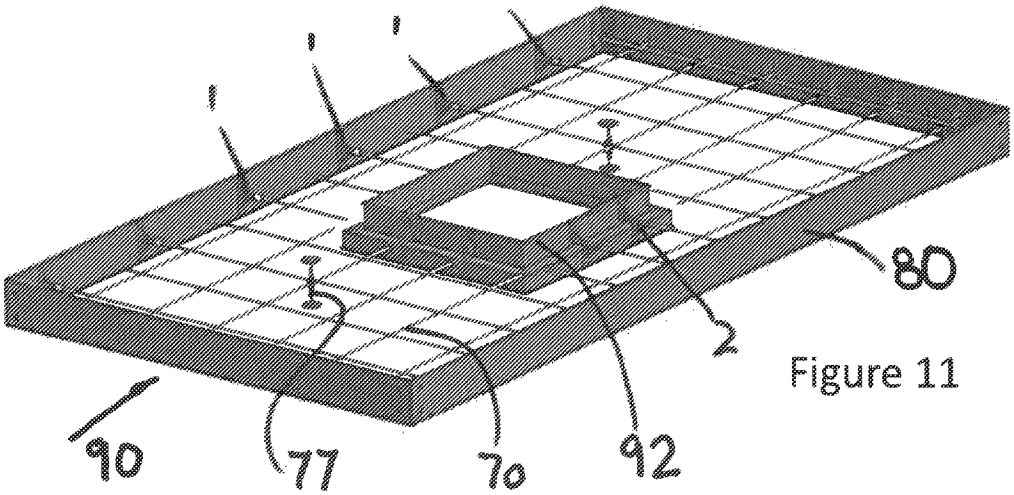
FIG. 11 is a perspective view of a preform panel, illustrating an internal support frame therein, providing a window detail to the slab using window clips.

Illustrated in FIG. 11 is a formwork 90, having an internal wall form 92 defining an aperture within the formwork 90. The remainder of the formwork 90 is constructed using a plurality of clips 1, reinforcing mesh 70 and four side walls 80 as described herein.

Figure 12:
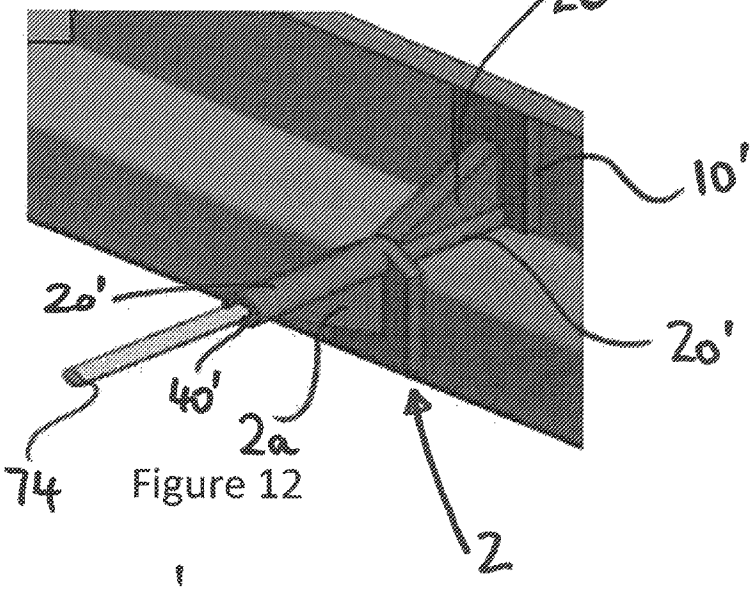
FIG. 12 is a perspective view of the window clip of FIG. 9, illustrating a staggered base.

To support the reinforcement mesh 70, around the internal wall form 92, there is provided a staggered clip 2, illustrated in FIGS. 11 and 12. This staggered clip 2 can be used in place of the arrangement illustrated in FIG. 5 which uses the clip 1 in combination with the connector 35.

The staggered clip 2 comprises two symmetrical portions 2*a*, 2*b*, arranged in series. Each portion 2*a*, 2*b* comprises a base 10' and a body 20' the body having a first channel 40'. The first channel 40' of each of the two portions 2*a*, 2*b* are coaxially aligned with a line wire 72 or a cross-wire 74 such that the wire 72, 74 is received into the first channel 40' of each of the two portions 2*a*, 2*b*. In this manner, the two portions 2*a*, 2*b* are rotatably affixed to the wire 72, 74.

Once attached to the wire 72, 74 the base 10' of the first portion 2*a* and the second portion 2*b* can be rotated independently, in a twist-lock action, to engage the internal wall form 92 and thereby brace the internal wall form 92 within the formwork 90. The bases 10' of the staggered clip 2 can be configured to cooperate with different standard forms of internal wall form 92, as desired.

Staggered clip 2 is made from a resilient material such as a reinforced plastic or alternative polymer material.

Figure 11A:
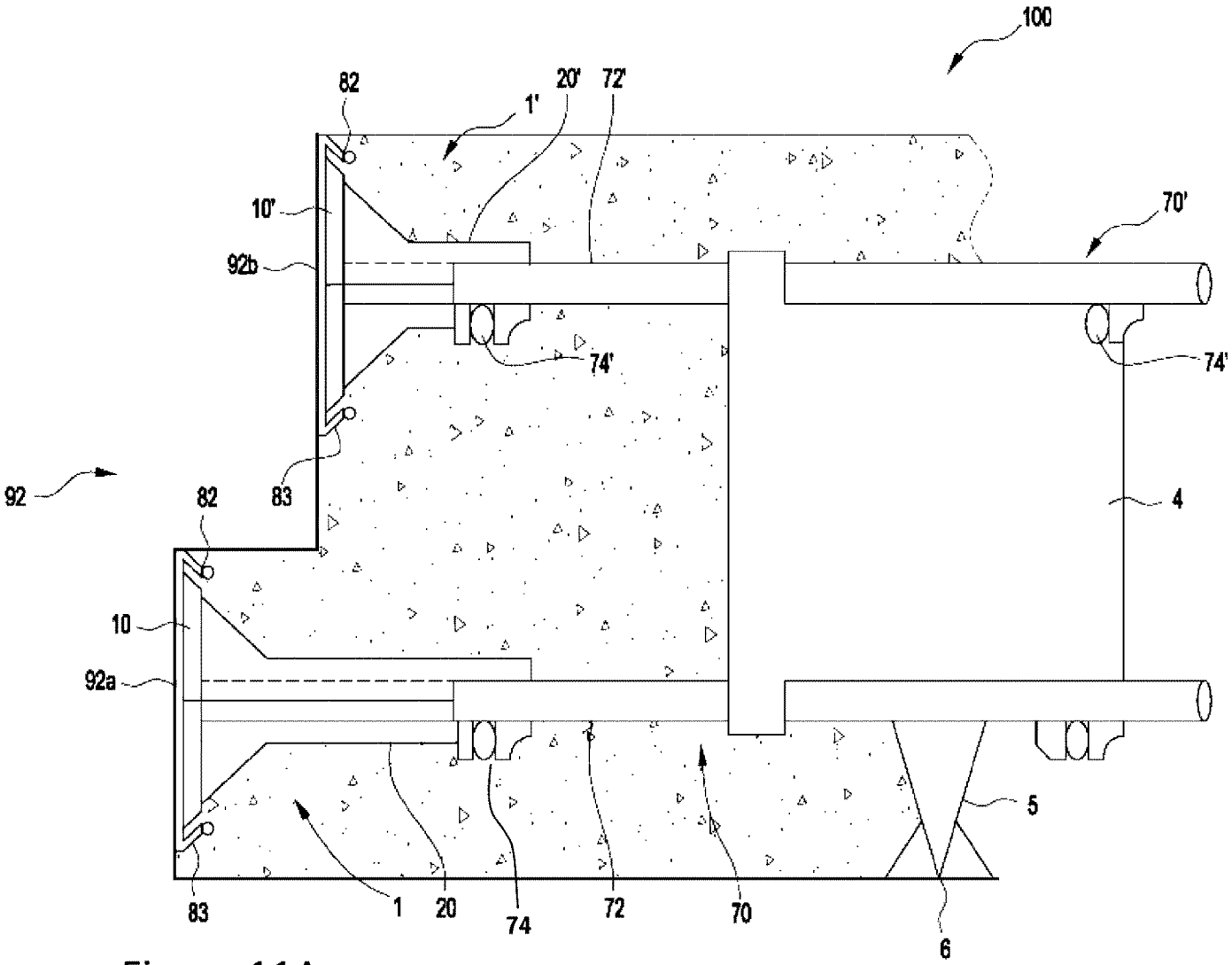
FIG. 11A is a sectional view of an arrangement for supporting a double layer of reinforcement mesh, using clips according to the clip of FIGS. 5 and 6.

In place of the staggered clip 2, described above, the clip 1 can be manufactured with different body lengths. Illustrated in FIG. 11A, a pair of clips 1, 1' are illustrated within a finished panel 100, the clip 1 having a longer body 20 than the body 20' of clip 1'. The difference in body length between the clip 1 and clip 1' is equivalent to a horizontal offset (or rebate) between a lower portion 92*a* and an upper portion 92*b* of internal wall form 92. FIG. 11A also illustrates a bracing block 4, positioned between two subsequent layers of mesh 70, to maintain a fixed relationship between the subsequent layers of mesh 70 and 70'. The bracing block 4 stops the mesh 70, 70' from moving out of line or laterally between the line wire 72 and cross-wires 74.

The bracing block 4 can further comprise a foot 5 that extends below the mesh 70. The foot 5 is dimensioned to extend to the outer face of the finished panel 100 and thereby provide additional support to the formwork 90. The foot 5 terminates in a point or apex 6. The apex 6 is sufficient to support weight upon but is also suitably small in cross-sectional area to not be visible in the finished panel 100. This arrangement of different length clips 1, 1' around the internal wall form 92 is especially useful when the internal wall form 92 is extruded aluminium or plastic, etc.

Figure 12A:
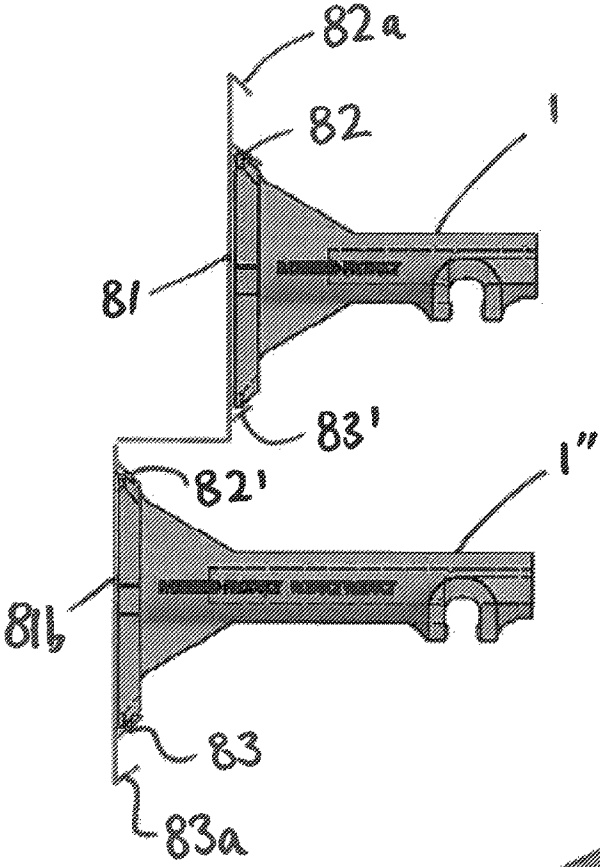
FIG. 12A is a side view of the clip of FIG. 4 in two different lengths so as to provide engagement with a rebated side wall.

As an alternative to clip 2, a pair of clips 1, 1" can be used where the clips 1, 1" are manufactured in differing body lengths, see FIG. 12A. In this embodiments clip 1" is approximately 20 mm longer in the body 20 to accommodate a rebated side wall 80. Similar to side wall 80 as illustrated in FIG. 10A, having a pair of upper lips 82, 82' and a pair of lower lips 83, 83', these attachments being located on two surfaces 81 and 81*b*, where surface 81*b* is rebated by 20 mm from surface 81.

Adjustable Clip

In a third aspect of the invention there is provided a clip 201 for use in the construction of a reinforced concrete panel 100, the panel 100 being reinforced by a mesh 270 comprising a plurality of parallel line wires 272 and a plurality of parallel cross-wires 274 connected to the line wires 272, the clip 201 comprising: a base 210 configured to engage a side wall 280 that, in use, defines a formwork 90; and a body 220 extending from the base 210, the body 220 being configured to receive a line wire 272 or a cross-wire 274 in any one of a number of predetermined positions in an operative position of the mesh 270.

Figures 15, 15A, 15B:
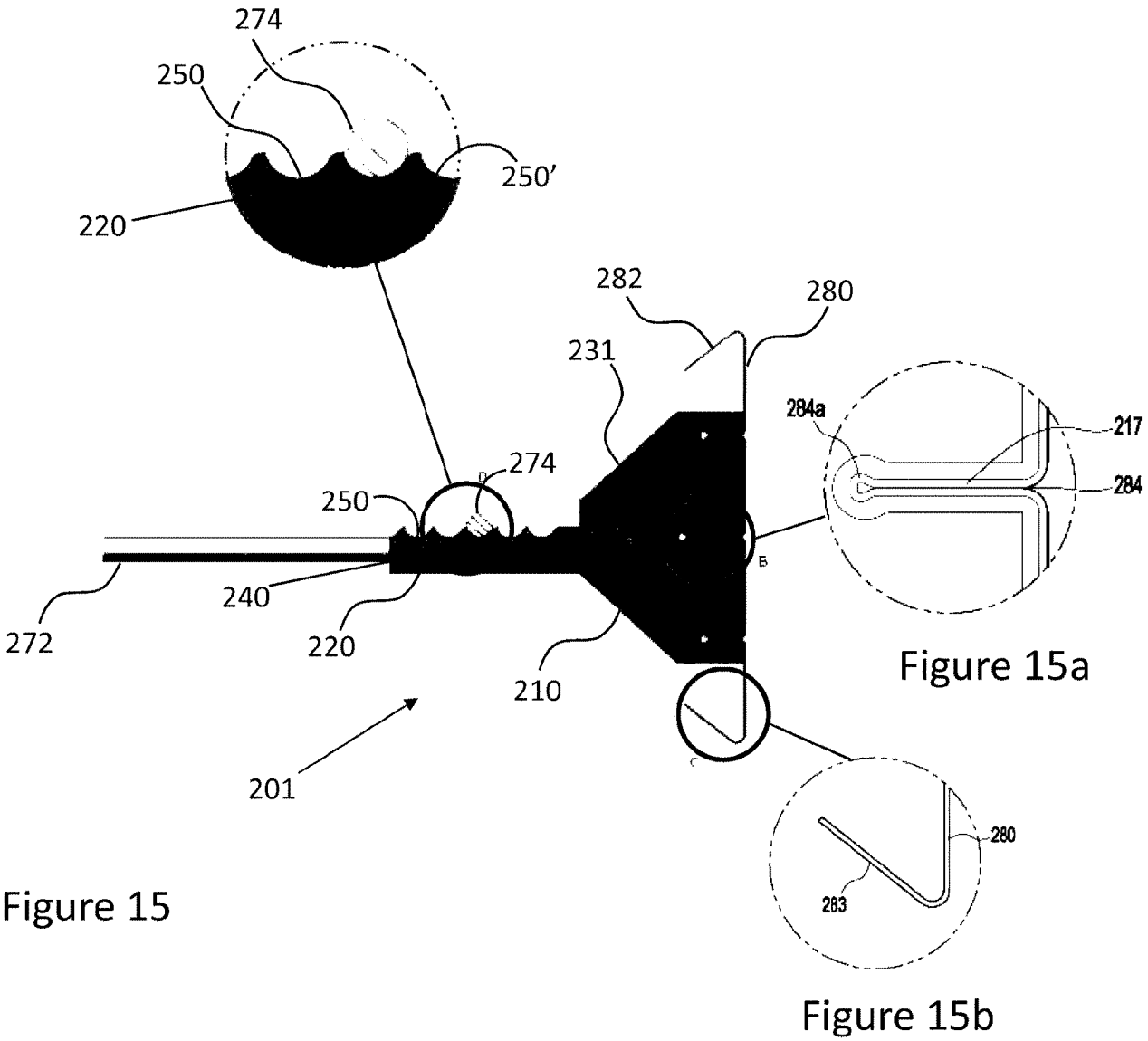
FIG. 15 is a side view of a clip receiving reinforcement bars, to keep a rigid edge for thick slabs and reduce the thickness of the side wall material.
FIG. 15*a* is an enlarged view of the circle B of FIG. 15, illustrating a snap-on feature of the side wall and clip.
FIG. 15*b* is an enlarged view of the circle C of FIG. 15, illustrating an acute lower lip of the side wall.
Figure 16:
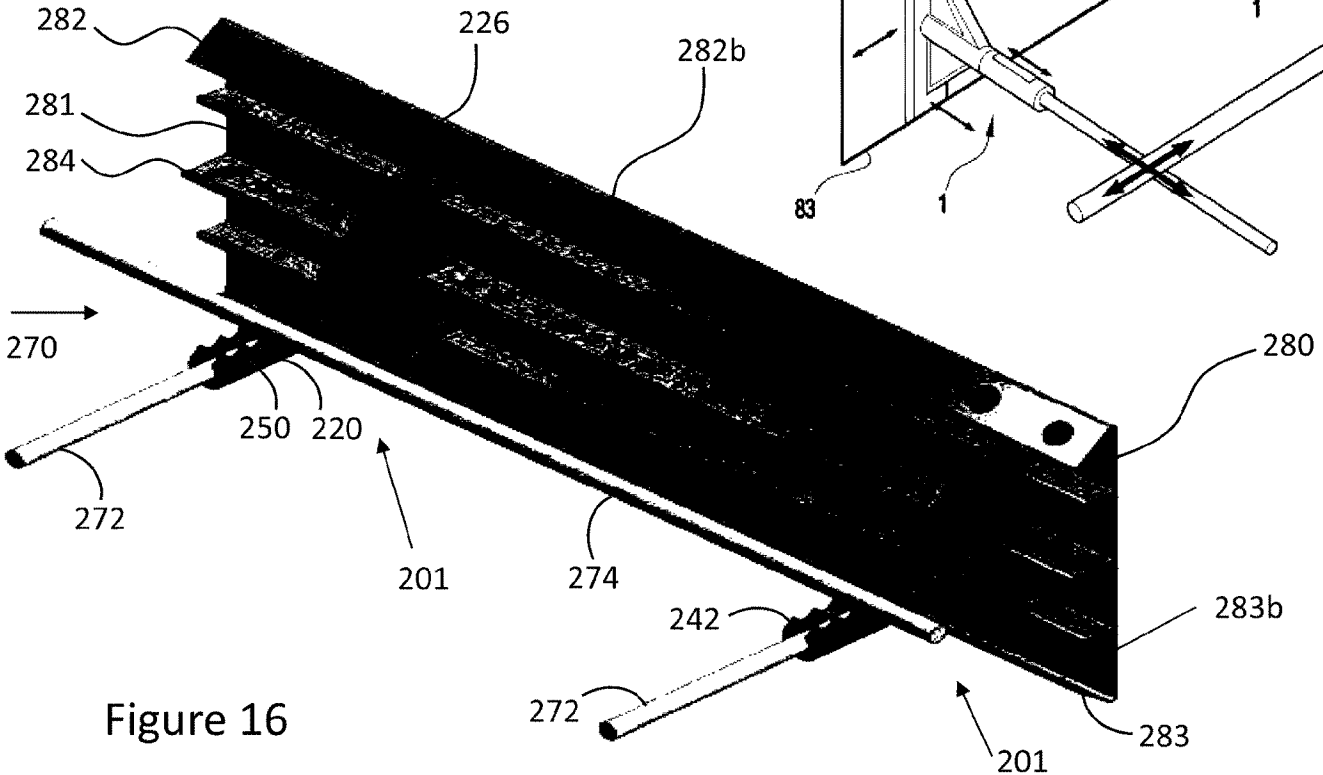
FIG. 16 is a perspective view of the reinforced clip of FIG. 15 engaged with a reduced thickness side wall.

FIGS. 15 and 16 illustrate a further embodiment of the clip 201 where the base 210 is configured to include slots 217 for cooperating with flanges 284 on the inner face 281 of the side wall 280.

The clip 201 comprises a base 210 and a body 220 extending therefrom. The base 220, in FIG. 15, is illustrated to include three slots 217. A single slot 217 can be used; however a plurality of slots 217 provides additional structural stability to the formwork 290. To provide additional structural stiffness to the clip 201, the cross-section of the base 210 is I-Shaped, providing a peripheral flange 231 to the base 210.

The side wall 280 is configured to provide a number of swages of flanges 284 on an inner surface 281*a* to engage with the base 210 of the clip 201. Accordingly, the clip 201 can be pushed-on, snapped-on or crimped-on to the side wall 280. Once in position the clip 201 can slide along the length of the side wall 280 using the flanges 284 as a form of guide rail along the side wall 280.

The flanges 284 are illustrated in FIG. 15*a* to have a rounded end 284*a* thereby providing the flange 284 with a retention feature to snap-on to clip 201. Similarly to clip 101, clip 201 can be slid into engagement with the side wall 280 at an end thereof or at a predetermined position along the length of the side wall 280 ie. end access to the side wall 280 is not required.

The body 220 of clip 201 provides a first channel 240 for receiving a line wire 272 or a cross-wire 274 of the mesh 270. The first channel 240 comprises a closed portion 244 and an open portion 242, such that the open portion 242 receives the wire 272, 274 and the closed portion 244 retains the wire 272, 274.

The base 210 of the clip 201 is initially engaged with the side wall 280, after which time the mesh 270 is placed onto the clip 201 which receives the line wire 272 in the first channel 240. Once the line wire 272 is received, the cross-wire 274 running perpendicularly to the wire 272 in the first channel 240 is received and retained by a second channel 250. As illustrated in FIG. 16, a plurality of second channels 250 can be provided, arranged in side-by-side configuration along the body 220, to retain the mesh 270 in any one of a plurality of predetermined positions relative to the side wall 280. In this manner clip 201 provides an adjustment mechanism for the formwork 290 depending on which of the plurality of second channels 250 is selected to receive and retain the cross-wire 274.

The second channel 250 is oriented perpendicularly to the first channel 240 and has a U-shaped cross-section. The diameter of the second channel 250 provides an interference fit for the wire 272, 274 to assist in retaining the mesh 270 in the operative position prior to the pouring of concrete into the formwork 290. In contrast, the first channel 240 provides a free-running fit to facilitate connection of the mesh 270 to the clip 201 and assembly of the formwork 290.

The side wall 280 is formed from a single panel and is easily produced in a variety of materials such as metals or plastic either through moulding, bending or extruding. FIG. 15*b* illustrates the acute angle of the lips 282, 283. In this embodiment, the side wall 280 is intended for use in constructing heavy duty panels and accordingly, the side wall 280 is constructed from a suitable gauge and strength of steel to support the loading of the desired panel 100.

The geometrical form of side wall 280 is simple to allow for extrusion or bending manufacture of the panel 280. The simplicity of the form also facilitates the use of stronger steels that would not easily or cost effectively be formed into more complex shapes.

In FIG. 16 a perspective view of the side wall 280 and clip 201 are illustrated. The upper and lower lips 282, 283 can be seen to provide a number of apertures 282*b*, 283*b* along their length. These apertures 282*b*, 283*b* allow the pourable concrete to flow through the lips 282, 283 improving the connection between the concrete mixture and the side wall 280.

Figure 17:
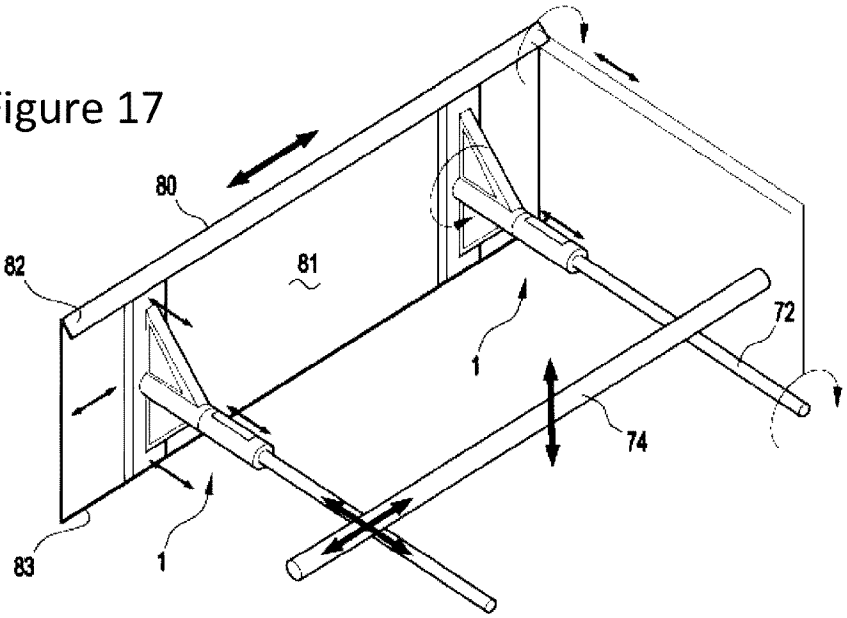
FIG. 17 is a schematic view of the forces resisted in the preform panel by the clips.

The forces exerted onto the clips 1 and mesh 70 are shown in FIG. 17, the arrows illustrating the direction of the forces as applied to the formwork 90. The clip 1 once locked in place is subject to any number of these compressive, tensile and rotational forces as the formwork 90 is transported and installed.

Figure 18:
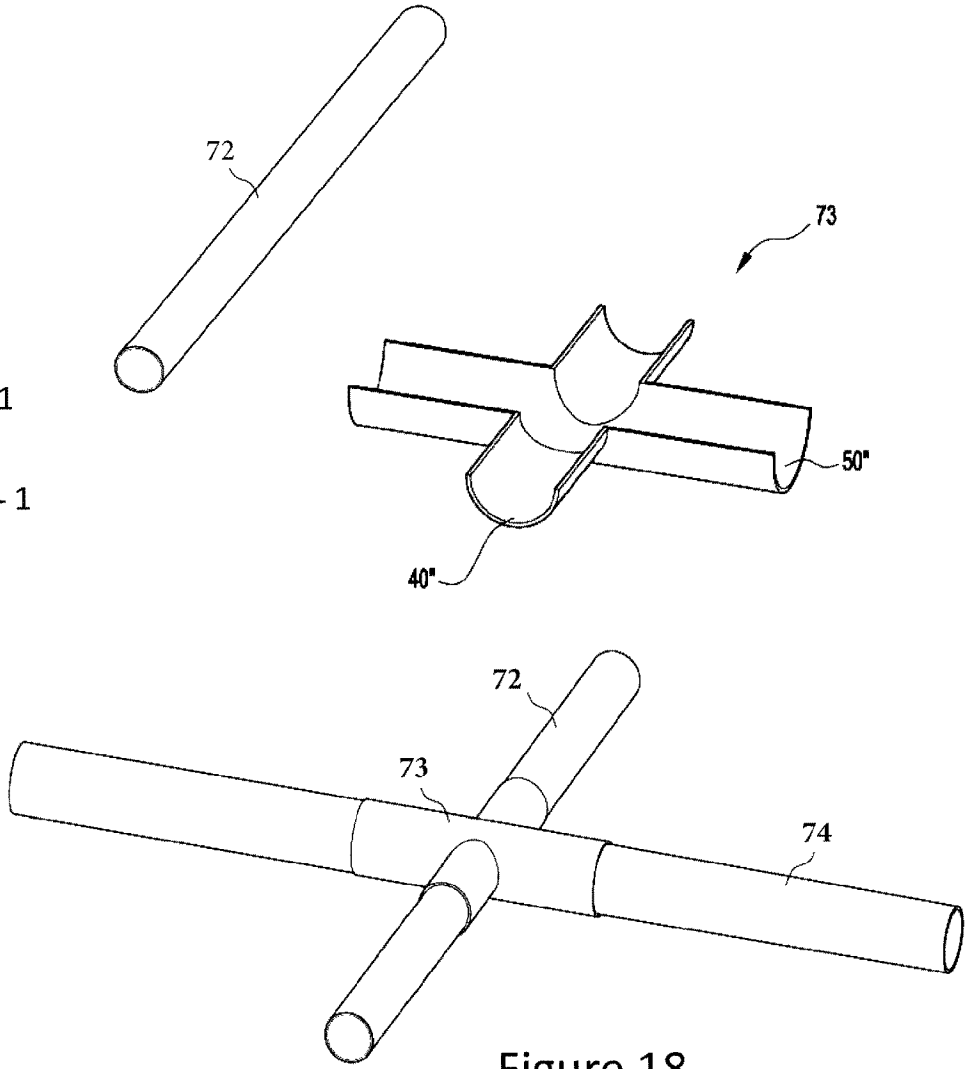
FIG. 18 is a perspective sketch of a bar-junction clip, to connect and stiffen non-welded reinforcement bars.

The line wires 72 and cross-wires 74 or the reinforcement mesh 70 are often welded together when the mesh 70 is manufactured. However, this typically applies to standard mesh sizes. Where the mesh 70 has not been welded at the cross-over points 75, or where a non-standard size mesh is to be used that is not welded, a cross-over clip 73 can be used to secure the line wires 72 and cross-wires 74 and stop them moving relative to one another. A cross-over clip 73 is illustrated in FIG. 18. These cross-over clips 73 can be dimensioned to connect/join perpendicular wires, rods or steel bars together and assist in resisting twisting forces within the mesh 70.

The cross-over clip 73 comprises a first channel 40" and a second channel 50" arranged perpendicularly to one another. The diameter of the first channel 40" and the second channel 50" is configured to provide an interference fit to the mesh 70 being used, such that the cross-over clip 73 can be pushed-on or snap-fitted to the cross-over points 75 on the mesh 70.

The cross-over clip 73 can be pressed or stamped from a resilient material like metal. Alternatively the cross-over clip 73 can be moulded from plastic in large volumes. It is not necessary to use a cross-over clip 73 at every cross-over point 75 in the mesh 70, however, the more cross-over clips 73 the stiffer the formwork 90.

The invention further provides a method of constructing a reinforced panel, the panel being reinforced by a mesh 70 comprising a plurality of parallel line wires 72 and a plurality of parallel cross-wires 74 connected to the line wires 72, the method comprising the steps of: (i) engaging a plurality of clips 1 with the plurality of parallel line wires 72 and the plurality of parallel cross-wires 74 of the mesh 70; (ii) orienting a plurality of side walls 80 to define a formwork around the mesh 70, such that each side wall 80 partially engages a base 10 of at least one clip 1; and (iii) rotating each clip 1 to retain the wire 72/74 via a twist-lock action in an operative position of the mesh 70.

Figure 19:
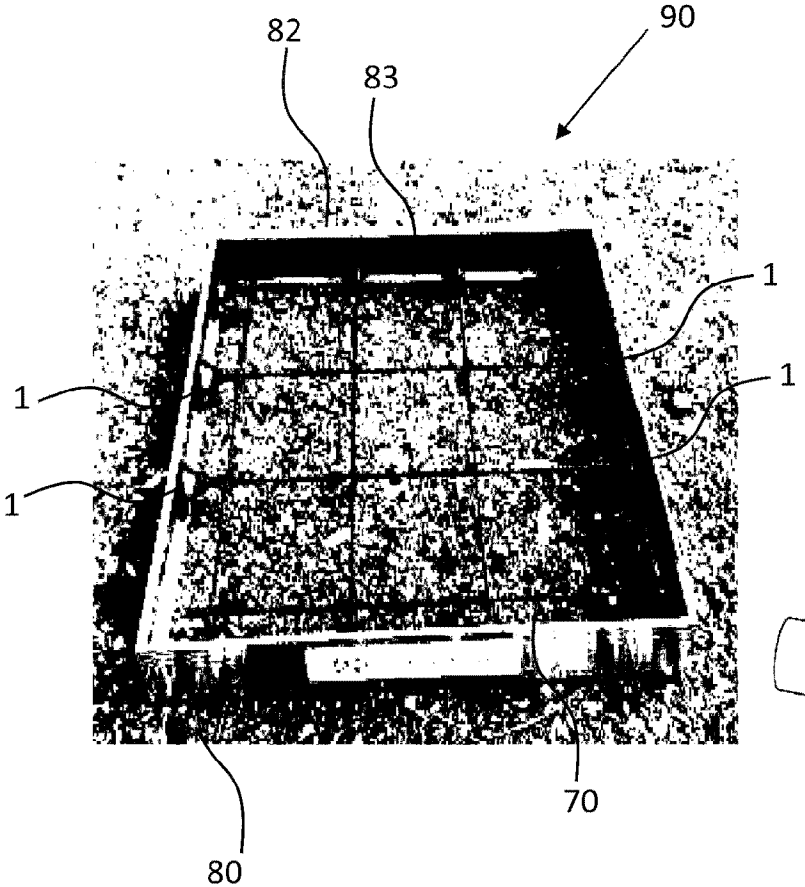
FIG. 19 is a photograph of a fully constructed concrete formwork, ready to receive a pourable substrate.

When preparing preform panels there are a number of different ways to hold the reinforcement mesh 70 and side walls 80 in proximity to receive a concrete mix eg. bars, welding, clamps, external reinforcements etc. Illustrated in FIG. 19, a plurality of clips 1 are used to hold a plurality of side walls 80 together and to support and retain the reinforcing mesh 70 in an operative position.

The reinforcing mesh 70 is purchased from standard stock and cut to a desired size. The plurality of clips 1 are then located on both the line wires 72 and cross-wires 74 around the periphery of the mesh 70. Specifically, the line wire 72 or cross-wire 74 is inserted into the first channel 40 of each clip 1, such that the clip 1 is free to rotate about the wire. Not every wire needs to be clipped; however, increasing the number of clips 1 will increase the stability of the formwork 90.

Four side wall 80 panels are then placed around the mesh 70 such that the base 10 of at least one clip 1 is in contact with the inner face 81*a* of each side wall 80, to create a square or rectangular formwork 90. Other shapes of preform panels can also be constructed and the invention is not taken to be limited to preform panels having four sides.

The side walls 80 can be attached to one another by corner pieces 87. An embodiment of these corner pieces 87 is illustrated in FIG. 1A, where each corner piece 87 comprises two planar faces 87*a*/87*b* disposed at right angle to one another. Each planar face 87*a*/87*b* is inserted into an open end 81*c* of two adjacent side walls 80 to retain the side walls 80 at right angles to one another. When all four side walls 80 have been interconnected with four corner pieces 87 a relatively stable preform structure is constructed. The reinforcing mesh 70 suspended within the side walls 80 further stiffens the structure and provides resistance to skewing of the formwork 90.

To lock the formwork 90 together, each clip 1 is rotated to engage the upper lip 82 and lower lip 83 with the opposing tapered ends 15 of the clip 1. As the clip 1 is rotated the engagement between the base 10 of the clip 1 and the side wall 80 is formed. Simultaneously, rotating the clip 1 rotates the first channel 40 about the wire 72, 74 therein and via a twist lock action, retains the wire 72, 74 within the second channel 50 of each clip 1 holding the mesh 70 in the operative position.

Upon initial engagement with the mesh 70, the clip can receive either of a line wire 72 or a cross-wire 74 into the first channel 40 and the rotation of the clip 1 urges the secondary channel 50 of the clip 1 into engagement with the other of the line wire 72 or the cross-wire 74 of the mesh 70.

Once the formwork 90 is constructed the formwork 90 can be reoriented or relocated prior to filling the formwork 90 with concrete to form the finished concrete panel 100.

In some embodiments a tray or base can be attached into an open face of the formwork 90. The base can be connected to at least one of the reinforcement mesh 70 and the side walls 80. The finished panel 100 having a tray can be used with beams and trusses for suspended applications.

Figure 20:
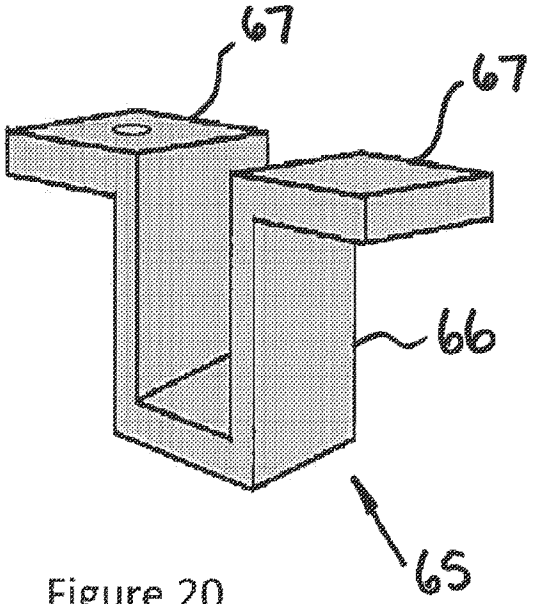
FIG. 20 is a perspective view of a connector for retaining a pair of preform panels in engagement with one another.

In some embodiments the side walls 80 are constructed from flexible materials to allow for curved panel profiles and more complex shapes.

Where multiple panels 100 are to be used adjacent one another, the finished panels 100 can be installed next to one another. As an alternative the formworks 90 can be aligned and secured in a predetermined configuration, prior to pouring of the concrete mix. A dowel or joint 65 is illustrated in FIG. 20 for joining the formworks 90 together.

The joint 65 comprises a constant thickness, U-shaped section. The body 66 of the joint 65 is configured to receive two contiguous side wall panels 80. The body 66 further provides two shoulders 67 disposed on either upright of the U-shaped body 66, to receive and not interfere with the clips 1 attached to each of the side walls 80.

Figure 21:
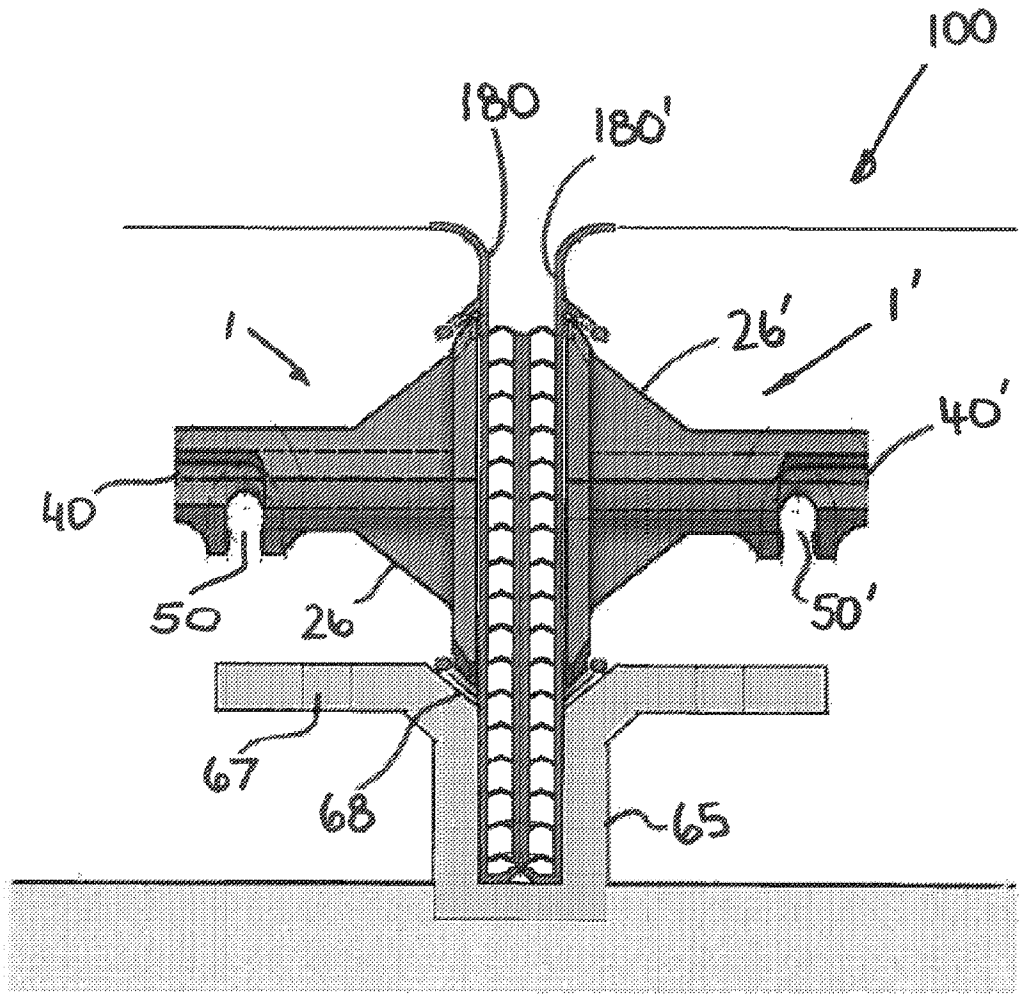
FIG. 21 is a side view of the connector of FIG. 20 connecting two preform panels.

FIG. 21 illustrates the joint 65 in an installed orientation, connecting a pair of lightweight sidewalls 180 engaged to a pair of clips 1. The lightweight side wall 180 has an upper lip 182 and no lower lip 183, such that the joint 65 can be slid over the overlaid side walls 180 below the clips 1. The shoulders 67 of joint 65 in FIG. 21 provide a recess 68 in which to receive the tapered ends 15 of the base 10 of the clip 1. In this manner, the joint 65 does not interfere with the twist-lock action of the clip 1. Once the two formworks 90 are secured to one another the concrete mix can be poured into the formwork 90 to cure.

To minimise on-site labour, the formwork 90 can be transported fully assembled, then simply installed in the desired location and filled with concrete. The panels can be suitably restrained in transit by securing them to a pallet. The formworks 90 are light and not cumbersome to transport as they can be nested. Some form of spacer or H-section can be placed on the formwork, vertically connecting the formworks 90 together and reducing the opportunity for damage in transit.

Bar chairs 76, 77 can be attached to the mesh 70 inside the formwork 90, supporting and separating the mesh 70 of adjacent formworks 90, and providing a thickness guide for the finished concrete. Bar chairs 76, 77 can also resist lateral forces, resist weight loads such as workmen, and resist the vertical distortions that can alter the vertical accuracy of the formwork 90.

Figure 22:
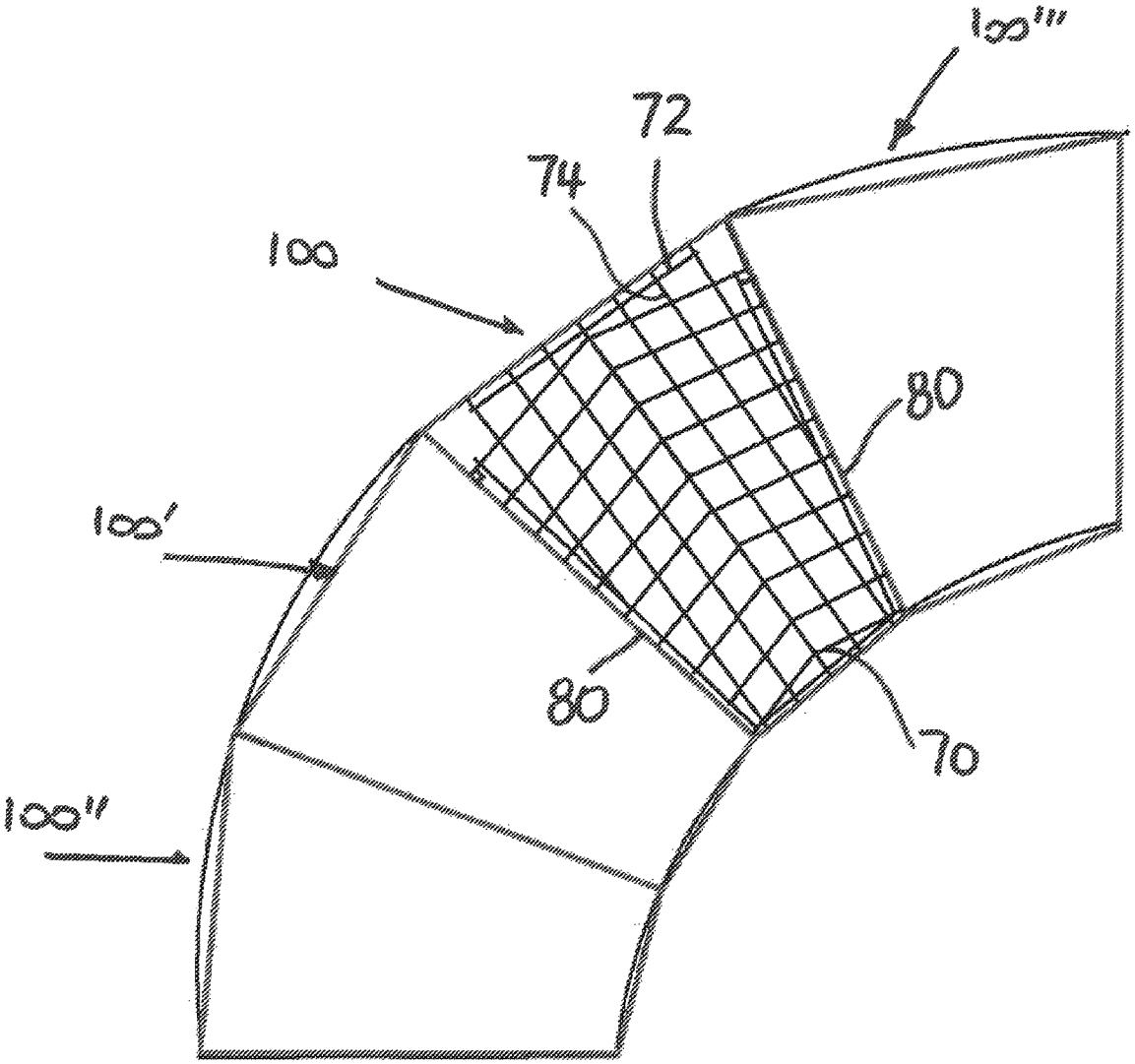
FIG. 22 illustrates a top view of a series of preform panels configured and arranged to define a curved concrete reinforced profile.

For further ease of transport, the clips 1 can be rotated to lie parallel within the formwork 90, yet remain attached to the reinforcement mesh 70. FIG. 22 illustrates a top view of a series of preform panels 100. Each formwork 90 is configured to form a trapezoidal finished panel 100, such that the finished panels 100 can be placed side-by-side to form a curved profile. Each of the panels 100 is constructed and formed as described herein using sidewalls 80, clips 1 and a mesh 70. However, the mesh 70 is fabricated to orient the line-wires 72 and cross-wires 74 perpendicularly to the side walls 80. Curved and arched pathways can be constructed in this manner to navigate fixed structures of the landscape e.g. trees, hydrants, pavements or merely for landscaping and aesthetic effect.

The formwork 90 provides a reinforced concrete slab which is easy to assemble, removing the requirement for highly skilled labour while still providing a high-quality product. The reinforcement mesh 70 is directly connected to the side walls 80, exploiting the internal structure of the reinforcement mesh to support the external perimeter formwork of the preform panel. The clips 1 connect the mesh 70 to the side walls 80 of the formwork 90, keeping the mesh 70 at a constant height and maintaining a predetermined distance between the mesh 70 and the side walls 80. The finished panel 100 can be produced and supplied in a ready-to-assemble kit form, or pre-assembled and ready to simply locate and fill with concrete. The reinforcement mesh 70 can be supplied as single bars which are more space-efficient, or as a premade mesh which is faster to assemble.

Hooks and connection points can be incorporated into the formwork 90, so that when the concrete has set, tents and other lightweight buildings can be securely fastened to the finished panel 100. The formworks 90 can be rapidly manufactured and deployed, following confirmation of the finished panel requirements for emergency relief applications eg. such as floods, earthquakes or other situations were temporary housing is required in a short time frame.

The formwork 90 makes the construction of concrete slabs simple and quick, requiring a low skill level to construct a high quality product. The finished panel 100 is designed for long-term durability, helping to provide a foundation on which a community can rebuild.

The formwork 90 provides consistent results as it has been engineered to deliver a robust, quality, durable finished panel, being produced from a simple, repeatable process. As the components of the formwork 90 are controlled and check when made, the only variable in the finished panel is the mix of concrete and surface finish of the concrete.

The reinforcement mesh 70 is held at a constant height across the finished panel 100 and the distance between the mesh 70 and outer surface of the finished panel 100 is constant, making the finished panel or slab more performance reliable, and less susceptible to degradation over time.

Once constructed the finished panel 100 can be used to provide a myriad foundations to pathways, decks, buildings, pavements, recreational areas, storage facilities, sheds, garages etc.

It will be appreciated by persons skilled in the art that numerous variations and modifications may be made to the above-described embodiments, without departing from the scope of the following claims. The present embodiments are, therefore, to be considered in all respects as illustrative and not restrictive.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, a limited number of the exemplary methods and materials are described herein.

It is to be understood that, if any prior art publication is referred to herein, such reference does not constitute an admission that the publication forms a part of the common general knowledge in the art, in Australia or any other country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A clip for use in the construction of a reinforced concrete panel, the panel being reinforced by a mesh comprising a plurality of parallel line wires and a plurality of parallel cross-wires connected to the line wires, the clip comprising:

a base configured to engage and be retained by a side wall that, in use, defines a formwork of the panel, wherein the base comprises a tapered profile for slidably engaging the side wall; and a body extending from the base, the body being configured to retain a line wire or a cross-wire of the mesh in an operative position of the mesh.

2. The clip according to claim 1, wherein the body retains the wire via a twist-lock action.

3. The clip according to claim 1, wherein the base is configured to be retained by the side wall via a twist-lock action.

4. The clip according to claim 1, wherein the body includes a passageway that can receive an end section of the line wire and a channel extending perpendicular to the passageway and positioned in relation to the passageway so that when the line wire is inserted into the passageway, the line wire can be rotated to locate the cross-wire in and be cradled by the channel.

5. The clip according to claim 4, wherein the passageway is perpendicular to the base.

6. The clip according to claim 4, wherein the channel is positioned laterally of the passageway so that the channel does not interfere with insertion of the wire into the passageway.

7. The clip according to claim 4, wherein a line that bisects the base and an axis of the channel both lie in a plane that is perpendicular to the base.

8. The clip according to claim 4, wherein the passageway is perpendicularly offset from the channel.

9. The clip according to claim 4, wherein the body further comprises an ear, the ear extending perpendicularly to each of the passageway and the channel.

10. The clip according to claim 9, wherein the ear includes an aperture for receiving fixings therein.

11. The clip according to claim 4, wherein the base, body, passageway and channel are integrally formed.

12. The clip according to claim 1, wherein the side wall that defines the formwork, provides a continuous mounting feature.

13. The clip according to claim 12, wherein the continuous mounting feature of the side wall receives the clip to form a detachable connection therebetween.

14. The clip according to claim 12, wherein the body includes a passageway that can receive an end section of the line wire or cross-wire of the mesh and a plurality of channels extending perpendicular to the passageway and positioned in relation to the passageway so that when the line wire or cross-wire is inserted into the passageway, the other of the line wire or cross-wire is located and retained in a predetermined one of the plurality of channels.

15. A concrete panel comprising a clip according to claim 1, a side wall that defines an outer perimeter of the panel, concrete within the perimeter defining opposite top and bottom surfaces of the panel, a mesh comprising a plurality of parallel line wires and a plurality of parallel cross-wires connected to the line wires embedded in the concrete, wherein the clip interconnects the side wall and the mesh.

16. A formwork assembly comprising a plurality of clips according to claim 1, a plurality of side wall panels that define a closed outer perimeter of the assembly and a mesh comprising a plurality of parallel line wires and a plurality of parallel cross-wires connected to the line wires, wherein the plurality of clips engage and retain the side walls to the mesh.

17. The clip according to claim 1, wherein the body includes a passageway that can receive an end section of the line wire or the cross-wire and a channel extending perpendicular to the body and positioned in relation to the body so that when the clip is rotated, the other of the line wire and the cross-wire is received and engaged by the channel, wherein the channel extends from opposing sides of the body.

18. A formwork assembly for a concrete panel comprising a plurality of side wall panels for defining a closed outer perimeter of the assembly, a reinforcement for the assembly comprising a plurality of parallel line wires and a plurality of parallel cross-wires, and a plurality of clips according to claim 1 for engaging and retaining the side walls and the reinforcement together.

* * * * *